US010961045B1

(12) United States Patent
Moses

(10) Patent No.: US 10,961,045 B1
(45) Date of Patent: Mar. 30, 2021

(54) DOCUMENT CONSOLE

(71) Applicant: XpresspaX, Inc., Hopkinton, MA (US)

(72) Inventor: David A. Moses, Hopkinton, MA (US)

(73) Assignee: XPRESSPAX, INC., Hopkinton, MA (US)

( * ) Notice: Subject to any disclaimer, the term of this patent is extended or adjusted under 35 U.S.C. 154(b) by 334 days.

(21) Appl. No.: 15/969,090

(22) Filed: May 2, 2018

Related U.S. Application Data

(60) Provisional application No. 62/501,232, filed on May 4, 2017.

(51) Int. Cl.

| | |
|---|---|
| ***B65D 85/62*** | (2006.01) |
| ***B42F 7/14*** | (2006.01) |
| ***B65D 25/00*** | (2006.01) |
| ***B65D 25/54*** | (2006.01) |
| ***B65D 25/14*** | (2006.01) |

(52) U.S. Cl.
CPC ..... *B65D 85/62* (2013.01); *B42F 7/14* (2013.01); *B65D 25/005* (2013.01); *B65D 25/14* (2013.01); *B65D 25/54* (2013.01)

(58) Field of Classification Search
CPC ..... B65D 85/62; B65D 25/14; B65D 25/005; B65F 1/1426; B65F 2240/1562; B42F 7/14
USPC ..... 206/425
See application file for complete search history.

(56) References Cited

U.S. PATENT DOCUMENTS

| | | | | |
|---|---|---|---|---|
| 3,981,436 | A * | 9/1976 | Neal | A47G 29/1207 232/17 |
| 4,308,953 | A | 1/1982 | Cohen | |
| 4,404,615 | A | 9/1983 | Dep | |
| 4,605,988 | A | 8/1986 | Nienhuis et al. | |
| 4,715,498 | A * | 12/1987 | Hanifl | B65F 1/08 206/366 |
| 4,873,811 | A * | 10/1989 | Izumitani | B02C 18/0007 53/139.1 |
| 4,893,759 | A | 1/1990 | Mizobata | |
| 5,105,968 | A * | 4/1992 | Fiterman | B65F 1/10 109/45 |
| 5,137,212 | A * | 8/1992 | Fiterman | B65F 1/10 109/46 |

(Continued)

FOREIGN PATENT DOCUMENTS

| | | |
|---|---|---|
| JP | 2015048187 | 3/2015 |
| WO | WO 2017040388 | 3/2017 |

OTHER PUBLICATIONS https://web.archive.org/web/20170320134344/http://www.shredders.ie/EBA-0201-OMD-Optical-Media-Shredding-p/shred0201omd.htm Accessed on Mar. 20, 2017.

(Continued)

*Primary Examiner* — Ernesto A Grano
(74) *Attorney, Agent, or Firm* — Doherty, Wallace, Pillsbury + Murphy, P.C.

(57) ABSTRACT

A document console comprising an upper member secured to a housing. The housing comprises side walls that are removably attached from one another thereby facilitating the manufacture, storage, and assembly of the console. The console comprises features and members that confer anti-static properties onto the console, thereby facilitating the removal of paper-based documents from the console. The console further comprises safety features that serve to maintain the security and the integrity of the documents within the console.

12 Claims, 37 Drawing Sheets

(56) References Cited

U.S. PATENT DOCUMENTS 5,205,406 A 4/1993 Bradford
5,244,281 A 9/1993 Williamson et al.
5,514,299 A 5/1996 Kalwara
5,535,946 A 7/1996 Clark et al.
5,667,136 A * 9/1997 Chen ..... B65F 1/1426 232/43.2
5,758,819 A * 6/1998 Sniegocki ..... B65F 1/10 109/46
5,871,162 A * 2/1999 Rajewski ..... B02C 13/04 241/100
5,906,281 A 5/1999 Fujikawa et al.
6,207,592 B1 3/2001 Nickell
6,390,323 B1 5/2002 Alticosalian
6,451,407 B1 9/2002 Nickell
6,585,843 B2 7/2003 Nickell et al.
6,592,702 B2 7/2003 Nickell et al.
6,719,195 B2 * 4/2004 Farentinos ..... A47G 29/22 232/45
6,762,157 B1 7/2004 Babinski et al.
D512,804 S * 12/2005 Wilson ..... D99/29
7,007,598 B1 * 3/2006 Patras ..... B30B 9/3007 100/35
7,159,762 B2 * 1/2007 Felice ..... A47G 29/1207 232/30
7,320,427 B2 * 1/2008 Prestwich ..... A47G 29/16 232/45
D569,074 S * 5/2008 Irwin ..... D99/29
7,673,825 B2 * 3/2010 Jeansonne ..... B02C 19/0075 241/100
8,002,172 B2 * 8/2011 Lager ..... B65F 1/1426 232/43.2
8,276,807 B1 * 10/2012 Andreozzi ..... A47G 29/141 232/43.3
8,336,792 B2 12/2012 Matlin et al.
8,523,050 B1 * 9/2013 Andreozzi ..... A47G 29/141 232/43.3
8,684,797 B2 4/2014 Chen
8,936,057 B2 1/2015 Sampica et al.
8,960,530 B2 * 2/2015 Silke ..... A47G 29/22 232/47
9,296,924 B2 3/2016 Kalwara et al.
9,717,359 B2 * 8/2017 Bolles ..... A47G 29/22
10,046,534 B2 * 8/2018 Faucher ..... B30B 9/3046
10,321,968 B2 * 6/2019 Burgess ..... A61B 50/362
10,517,417 B2 * 12/2019 Kutas ..... A47G 29/1251
10,799,050 B1 * 10/2020 Glaser ..... A47G 29/20
2005/0241449 A1 11/2005 Chen
2006/0191949 A1 * 8/2006 Miller ..... B65F 1/1615 220/835
2007/0087149 A1 4/2007 Arthurs et al.
2007/0189932 A1 8/2007 Glenn et al.
2008/0246239 A1 * 10/2008 Connor ..... B65F 1/1615 280/47.26
2009/0079306 A1 * 3/2009 Lager ..... B65F 1/1426 312/293.2
2010/0167001 A1 7/2010 Wang
2011/0240513 A1 * 10/2011 Busch ..... B65F 1/10 206/555
2015/0076152 A1 * 3/2015 Buck ..... B65F 1/02 220/495.08
2015/0284141 A1 10/2015 Ni
2015/0328819 A1 11/2015 Tom et al.
2016/0185521 A1 6/2016 Lecocq et al.
2016/0361233 A1 12/2016 Chou et al.

OTHER PUBLICATIONS https://www.semshred.com/0202omd_anti_static_bags Accessed on Mar. 20, 2017.
https://www.amazon.com/SANWA-SUPPLY-shredder-antistatic-PSD-CD2/de/B005FUDRPA May 7, 2014.

* cited by examiner

FIG. 11
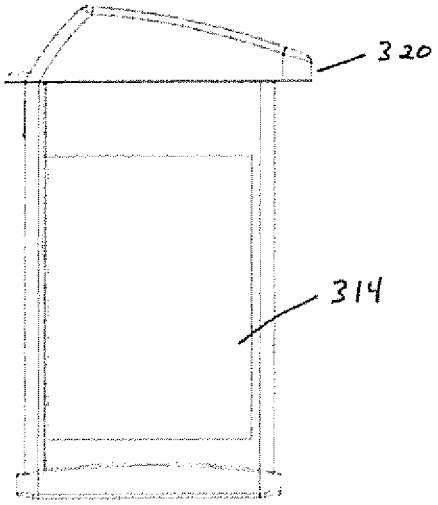
FIG. 12
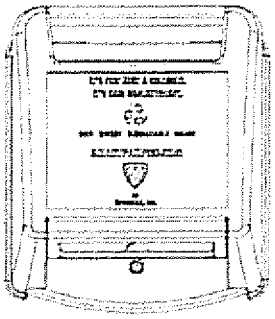
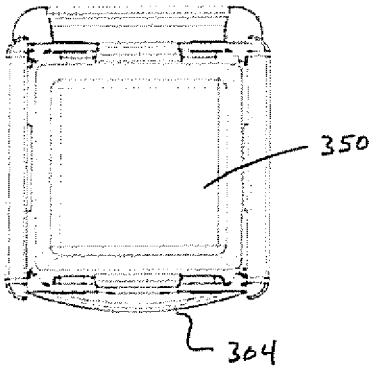
FIG. 13

300

DOCUMENT CONSOLE

BACKGROUND OF THE INVENTION

1. Field of the Invention

This application relates to document consoles. In particular, this application relates to document consoles which are used to store documents prior to shredding.

2. Background of the Invention

In many businesses, multiple draft copies of paper documents are generated in the process of developing a final version of the document. The draft copies will not be used and need to disposed of. Additionally, documents to be shredded may also include confidential information. These documents cannot simply be placed in a recycle bin because they are confidential. Instead, the documents need to be destroyed. Businesses often do not have a means of destroying documents, for example, by shredding, available at all times. Documents need to be accumulated for periodic shredding.

A document console can be used to accumulate these documents. A typical document console is a rectangular box with an opening through which documents can be inserted. The documents are accumulated inside the document console in a receptacle, such as a bag or a bin. The console typically has a lockable door.

A typical method for emptying conventionally known consoles is to have a route driver go to a building having one to a few hundred consoles that need to be checked by the route driver to assess whether it is time to empty the console. Should the console need emptying, the route driver accesses the receptacle contained in the console, and dumps the contents of the receptacle into a barrel, typically, a 95 gallon wheeled, locked trash barrel. The driver repeats this process for each console contained at the site. When finished checking each console, the driver loads the trash barrel on a truck, and transports the barrel to an offsite shred facility. Additionally, some service trucks allow for onsite curb-side shredding at the customer facility.

Document consoles are often made of melamine particle board. Five sheets of the melamine particle board are screwed together with metal fasteners to form sides, a top and a bottom, and the melamine door is attached with a metal hinge. Metal hooks or a rigid wire frame are used to hold the receptacle in place inside the document console. It is sometimes necessary to move the document console, for example, when it is shipped or when it is moved within its deployed location. This causes damage to the console, which in turn creates a security risk thereby rendering the console useless. In addition, melamine consoles are very heavy and create a risk of injury when moving.

Also, the metal hooks used to hold the bag in place inside the document console leave significant gaps between the bag and the sides of the console. This allows documents to slide down between the bag and the sides of the console so that the person emptying the document console needs to inspect the interior of the document console once the bag is removed to see if any documents have been missed. Additionally, the bag, when full of documents, is cumbersome and unwieldy to empty into the mobile bin, and can cause damage to, or premature removal of, the metal hooks.

Also, because conventionally known consoles are generally heavy, solid structures, it is difficult for an employee to determine how full the interior receptacle is with documents to be shredded without unlocking the door and checking the internal contents, as a nearly empty console does not need to be processed or emptied. Therefore, checking the volume of documents held by a particular console is time-consuming and invades privacy.

SUMMARY OF THE INVENTION

The deficiencies and drawbacks of the current practices are alleviated by a document console comprising a housing and a cabinet member. The cabinet member, which, in an exemplary embodiment, is an integrally formed unit, is designed to securely hold documents, whilst further allowing the holding capacity of the cabinet member to be ascertained. The housing, which, in an exemplary embodiment, is an integrally formed unit, is designed to serve as a source for the deposit of the documents into the cabinet member and is further designed to securely hold the cabinet member when the cabinet member is engaged with the housing. Both the housing and the cabinet member are further designed such that the cabinet member can be removed readily from the housing and such that the process of emptying the documents from the cabinet member for purposes of shredding the documents is greatly simplified over conventionally known methods, and such that the contents are emptied from the cabinet member in a more secure fashion.

In addition, a transparent window in the front of the designed console allows an employee to determine the degree to which the internal receptacle is full of documents, providing a quicker decision as to whether or not the console needs servicing (emptying), thereby saving considerable resources.

Other aspects and features of the present invention will become apparent, to those ordinarily skilled in the art, upon review of the following description of the specific embodiments of the invention.

BRIEF DESCRIPTION OF THE DRAWINGS

FIG. 1I is a schematic depicting a proximal side view of the document console shown in FIG. 8;

FIG. 12 is a schematic depicting a top side view of the document console shown in FIG. 8;

FIG. 13 is a schematic depicting a bottom side view of the document console shown in FIG. 8;

DETAILED DESCRIPTION OF THE INVENTION

The application relates to a document console. Although the document console is specially designed to receive and to hold paper documents that are to be shredded, the document console is not to be so limited, but may also be used to store other types of materials in which the confidentiality of such materials is to be maintained throughout the storage process. Such documents may include, for example, computer hard drives, and the like.

When it is time to empty the contents of the console, an exemplary console is designed to allow a user to easily unlock and disengage a drawer member which holds the documents from a housing, to empty the contents from the drawer member, and to then easily reengage the drawer member with the housing and to lock the drawer member to the housing to thereby ensure that any future documents disposed within the console are securely positioned within the console.

The drawer member is designed to hold the documents in a secure fashion without the need of any accessory parts. The drawer member is further designed to allow visibility of the holding capacity of the drawer member. That is, the drawer member is designed such that a user can visibly detect the amount of documents held by the drawer member at any point in time so that the user can visibly determine when the drawer member has reached its maximum holding capacity. The housing is configured to allow for the secure deposit of materials into the drawer member, and to prevent unauthorized removal of the deposit materials from the drawer member.

To facilitate: (1) manufacturing of the document console, (2) document storage, and (3) console transportation, both the housing and the drawer member are integrally formed members. In an exemplary embodiment, both of the housing and the drawer member are formed from injection molding, blow molding, thermoforming, and the like, and are preferably formed from plastic resins, such as, e.g., at least one of EPS, EPP, HDPE, PP, and the like, though other materials and manufacturing processes may be used to form the housing and the drawer member.

Figure 1:
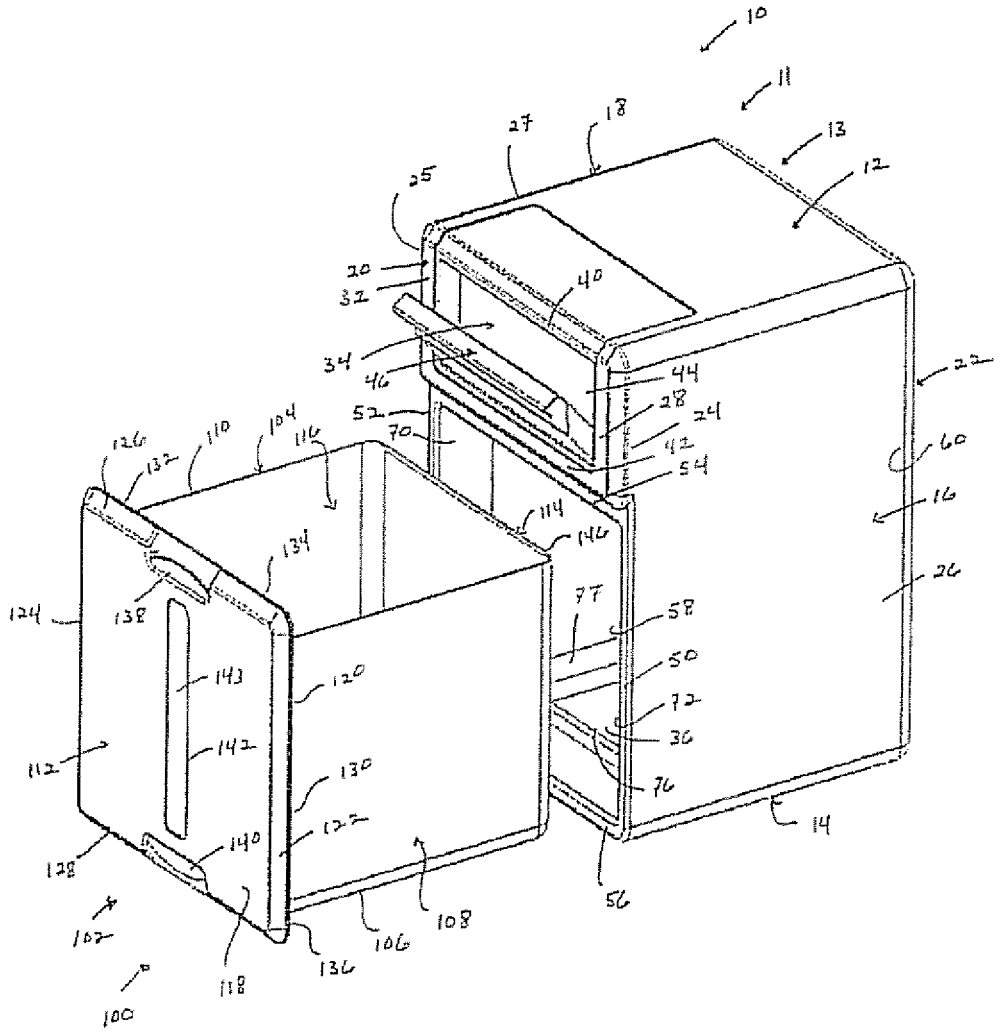
FIG. 1 is a schematic depicting an elevational side view of an exemplary console.
Figure 2:
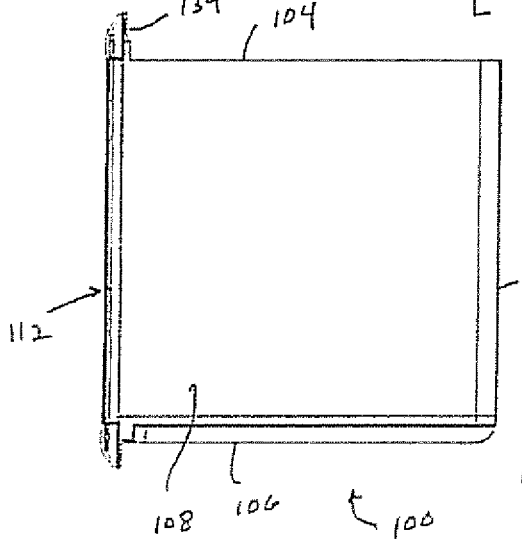
FIG. 2 is a schematic depicting a side view of an exemplary drawer member.
Figure 3:
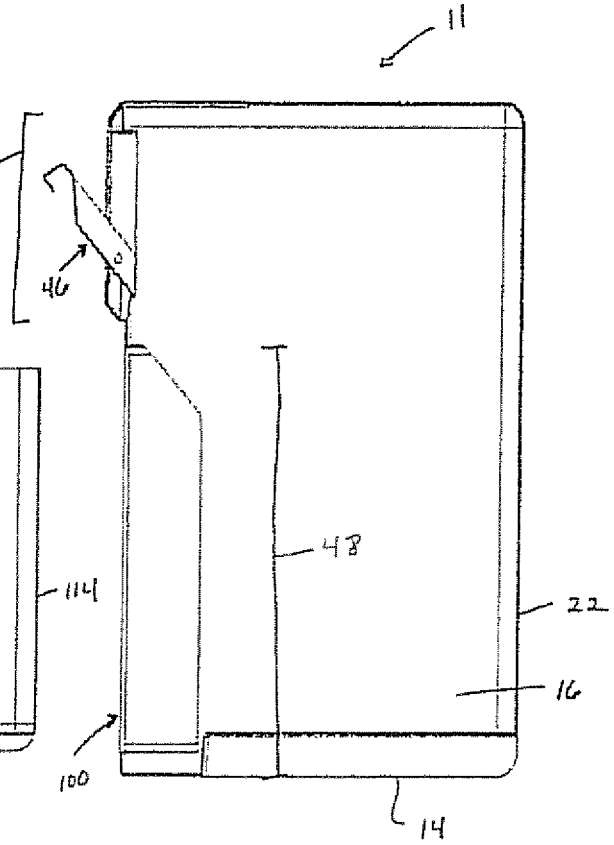
FIG. 3 is a schematic depicting a side view of the console depicted in FIG. 1.
Figure 4:
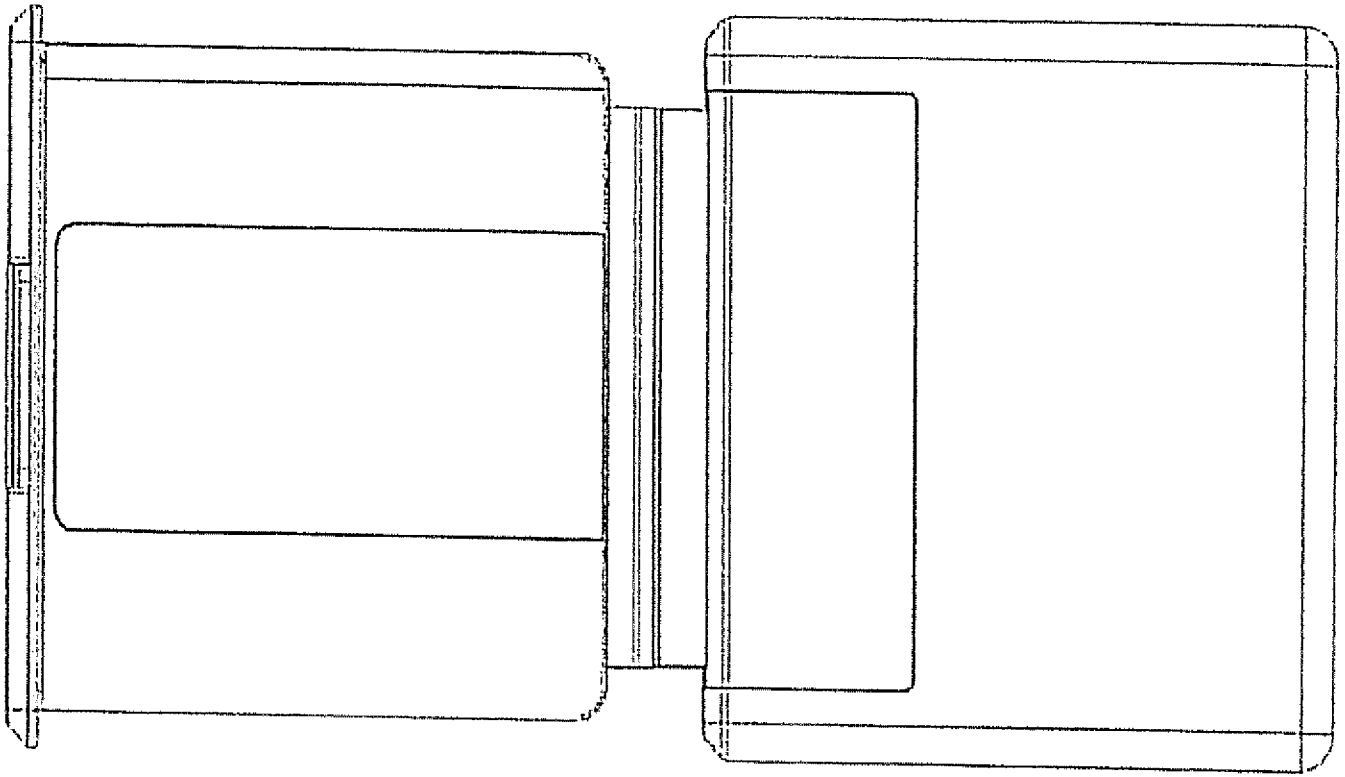
FIG. 4 is a schematic depicting a top side view of the console depicted in FIG. 1.

An exemplary console shall now be described more specifically with reference to the figures, wherein it is understood that the figures are not limiting, but that modifications to the figures as would be obvious to one of skill in the art are encompassed within this disclosure. FIG. 1 shows a document console 10 according to an exemplary embodiment of the invention. Document console 10 has a generally rectangular box shape. In this embodiment, document console 10 comprises a housing 11 having a generally cuboidal-shaped body 13. Body 13 comprises a top wall 12 oppositely situated to a bottom wall 14, a proximal wall 16 oppositely situated to a distal wall 18, and a forward wall 20 oppositely situated to a rearward wall 22. Top wall 12, bottom wall 14, proximal wall 16, distal wall 18, forward wall 20, and rearward wall 22 surround a chamber 34.

Each of proximal and distal walls 16 and 18 has a substantially L-shaped configuration, and, therefore, each respectively comprises a flange member 24 and 25 which perpendicularly extends respectively from a generally rectangular shaped body 26 and 27 at an uppermost region of respective body 26 and 27. Each of proximal and distal walls 16 and 18 is arranged perpendicularly to top and bottom walls 12 and 14 and to forward and rearward walls 20 and 22, and each is arranged parallel to the other such that flange member 24 of proximal wall 16 is directed towards and integrally formed with a proximal wall 28 of an upper portion 30 of forward wall 20, and flange member 25 is directed towards and integrally formed with a distal wall 32 of upper portion 30 of forward wall 20.

Proximal wall 28 and distal wall 32, in addition to an upper wall 40 and a lower wall 42 of upper portion 30, surround an opening 44 formed in upper portion 30. Opening 44 leads directly into chamber 34. A door 46 is hingedly connected to proximal and distal walls 28 and 32 and is positioned over opening 44 such that opening 44 is concealed by door 46 when door 46 is in a "closed position", and such that opening 44 is visible when door 46 is in an "open position."

Forward wall 20 further comprises a lower portion 48 disposed between lower wall 42 of upper portion 30 of forward wall 20 and bottom wall 14. Lower portion 48 comprises a proximal wall 50 oppositely situated to a distal wall 52, and an upper wall 54 oppositely situated to a lower wall 56. Proximal wall 50, distal wall 52, upper wall 54, and lower wall 56 are coplanar with one another. Additionally, proximal and distal walls 50 and 52 are parallel and recessed relative to proximal and distal walls 28 and 32, and upper and lower walls 54 and 56 are parallel and recessed relative to upper and lower walls 40 and 42. A generally rectangular-shaped opening 58, which leads into chamber 34, is formed between proximal wall 50, distal wall 52, upper wall 54, and lower wall 56.

Each of top wall 12 and bottom wall 14 has a generally square configuration and each is arranged parallel to one another, and perpendicularly and integrally formed with forward and rearward walls 20 and 22 and with proximal and distal walls 16 and 18. Bottom wall 14 has an interior face 36 directed towards chamber 34. A generally rectangular-shaped frame member 38 is disposed on and extends from interior face 36 towards top wall 12 and is integrally joined to and formed with an interior face 70 of distal wall 18, an interior face 72 of proximal wall 16, and an interior face 74 of rearward wall 22. An opening 76 is centrally formed through frame member 38, thereby revealing interior face 36 of bottom wall 14, wherein face 36 is recessed relative to a top side 77 of frame member 38.

Document console 10 further comprises a drawer member 100. In the embodiment depicted, drawer member 100 comprises a generally cubed shaped body 102, wherein body 102 comprises an open ended top side 104 oppositely situated to and formed parallel with a bottom side 106, a proximal side 108 oppositely situated to and formed parallel with a distal side 110, and a forward side 112 oppositely situated to and formed parallel with a rearward side 114. A chamber 116 is bordered by top and bottom sides 104 and 106, proximal and distal sides 108 and 110, and forward and rearward sides 112 and 114.

Each of proximal and distal sides 108 and 110 perpendicularly extends from and is integrally formed with open-ended top side 104, bottom side 106, and forward and rearward sides 112 and 114.

Forward side 112 comprises an outer face 118 oppositely situated to and coplanar with an inner face 120, a proximal lateral wall 122 oppositely situated to and coplanar with a distal lateral wall 124, and a top side wall 126 oppositely situated to and coplanar with a bottom side wall 128. Inner face 120 is centrally disposed on and attached to forward terminal ends of proximal and distal sides 108 and 110 and of top and bottom sides 104 and 106 such that proximal and distal sides 108 and 110 and top and bottom sides 104 and 106 are recessed relative to forward side 112 to thereby create a proximal overhang 130 between proximal lateral wall 122 and proximal side 108, a distal overhang 132 between distal lateral wall 124 and distal side 110, a top overhang 134 between top side wall 126 and top side 104, and a bottom overhang 136 between bottom side wall 128 and bottom side 106.

A groove 138 is centrally formed through top side wall 126 and extends into outer face 118. A groove 140, which is coaxial with groove 138, is centrally formed through bottom side wall 128 and extends into outer face 118.

A slot 142, which longitudinally extends towards top and bottom side walls 126 and 128, and which is positioned between grooves 138 and 140, is centrally formed through outer and inner faces 118 and 120. In an exemplary embodiment, a transparent member 143 is positioned within slot 142 such that chamber 116 cannot be accessed via slot 142, but also such that contents positioned within chamber 116 may be visible. In an exemplary embodiment, the transparent member may be formed of at least one of plastic, glass, and the like.

Drawer member 100 is fully engaged with body 13 of housing 11 of console 10, when bottom side 106 of drawer member 100 is physically engaged with top side 77 of frame member 38 of housing 11, and an exterior face 146 of rearward side 114 physically abuts an interior face 60 of rearward wall 22 of body 13 of housing 11. In an exemplary embodiment, a key-enabled lockset device comprising a latch and opposing catch secure drawer member 100 in place. Additionally, when drawer member 100 is fully engaged with body 13, proximal overhang 130 physically abuts proximal wall 50, distal overhang 132 physically abuts distal wall 52, top overhang 134 physically abuts upper wall 54, and bottom overhang 136 physically abuts lower wall 56 such that outer face 118 of forward side 112 is coplanar with proximal side wall 28, distal side wall 32, upper side wall 40, and lower side wall 42 of forward wall 20 of body 13 of housing 11.

The console as described above-herein is designed such that documents that need to be shredded may be done so in a confidential manner. When in use, drawer member 100 is fully engaged with housing 11 as described above. Documents may be disposed within chamber 116 via the opening of door 46. Due to the transparency of transparent member 143 contained in slot 142, a user visibly can detect when body 102 of drawer member 100 has reached its maximum carrying capacity. Drawer member 100 may be removed from housing 11 by grasping either one or both of grooves 138 and 140 and pulling drawer member 100 away from housing 11. The documents may be accessed directly from chamber 116 which holds the documents after the documents are inserted within console 10 through door 46.

In an exemplary embodiment, document console 10 may be transported to a shredding facility. As both housing 11 and drawer member 100 are integrally formed, and as drawer member 100 is securely engaged with housing 11, console 10 is easily transported to an off-site shredding facility. When it is time to shred the materials, drawer member 100 is readily and quickly disengaged from housing 11. Grooves 138 and 140 assist a user in lifting drawer member 100 and emptying drawer member 100 of the documents that are to be shredded. Once the documents are emptied from chamber 116, drawer member 100 is again engaged with housing 11 as described above, and console 10 may be transported and returned to its place for use as a receptacle for documents to be shredded.

In an exemplary embodiment, the document console further comprises an electronic access control device that can allow a pay-as-you go option for the public to access the console and dispose of items to be shredded via cash, debit, credit, FOB, and the like.

Figures 5, 6:
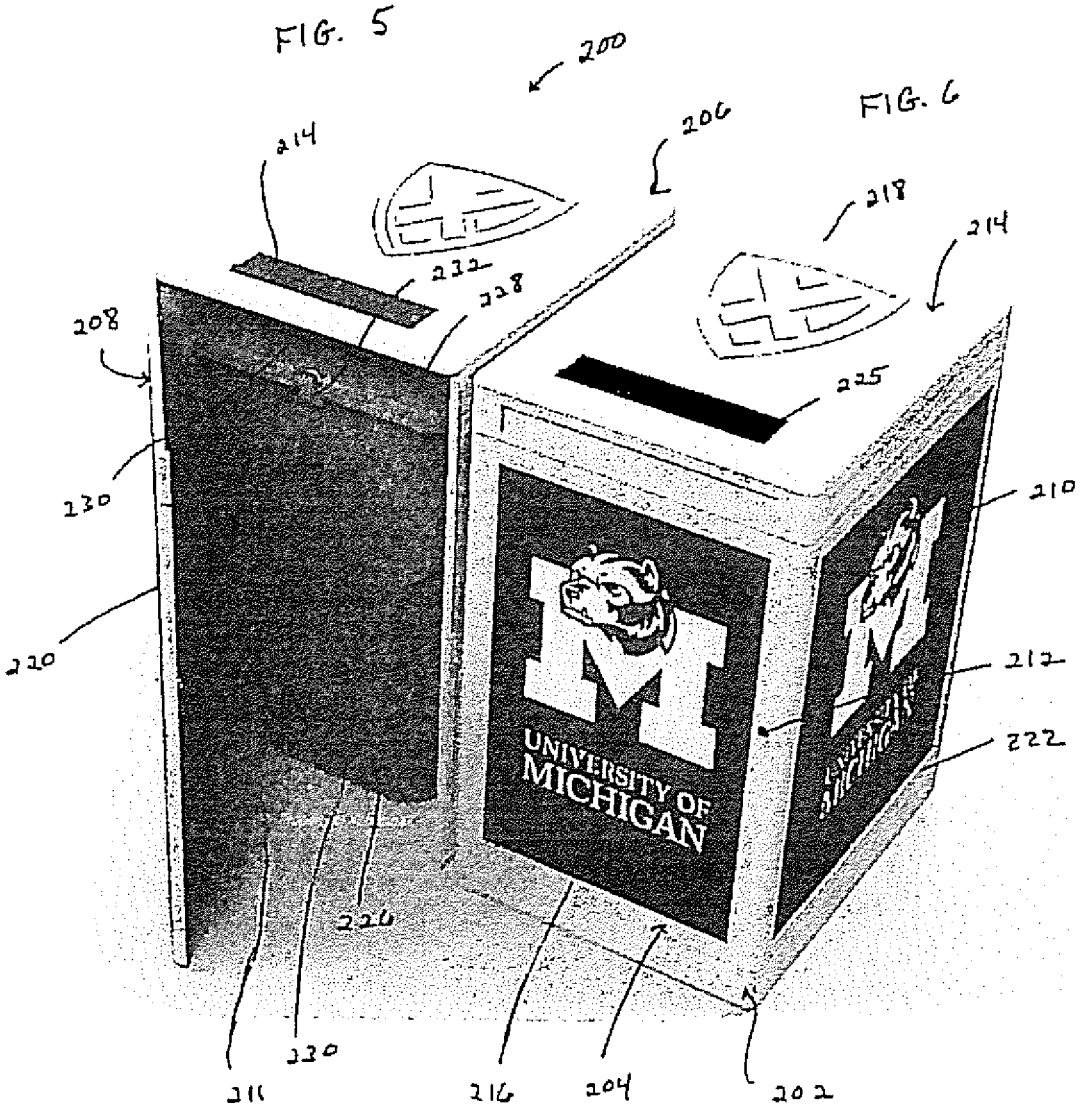
FIG. 5 is a schematic depicting a front side of another exemplary document console, wherein the document console is in an open position.
FIG. 6 is a schematic depicting a front side of the document console shown in FIG. 5, wherein the document console is a closed position.
Figure 7:
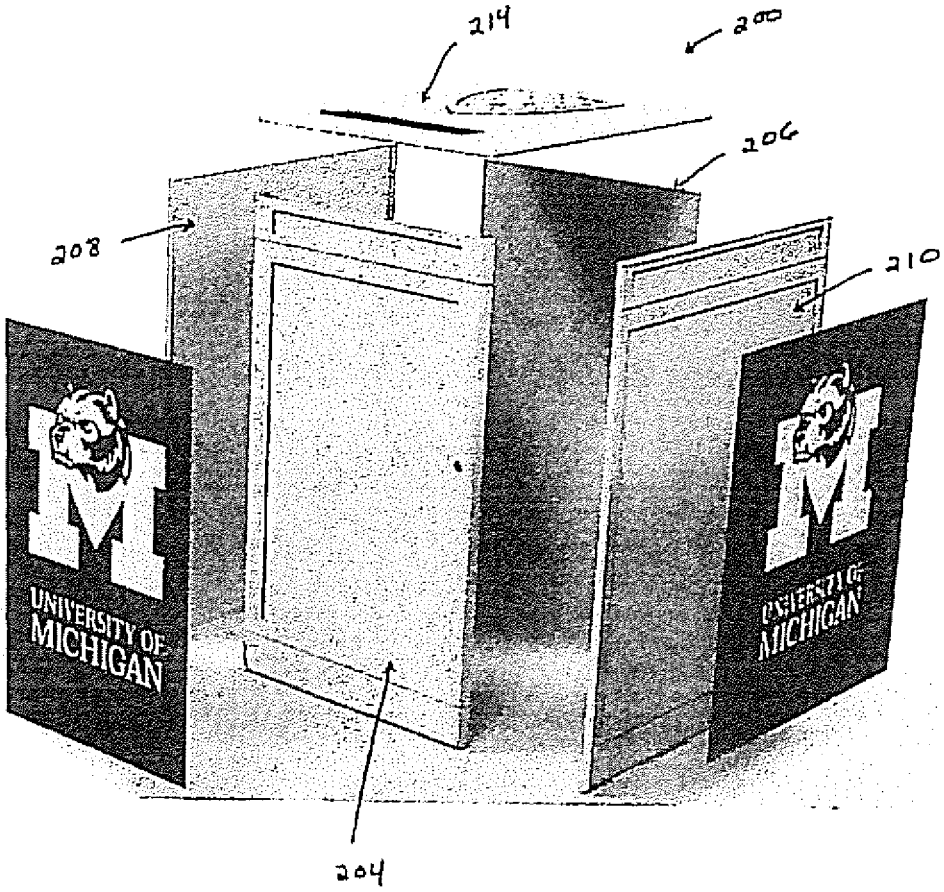
FIG. 7 is an exploded view of the document console depicted in FIGS. 5 and 6.
Figure 8:
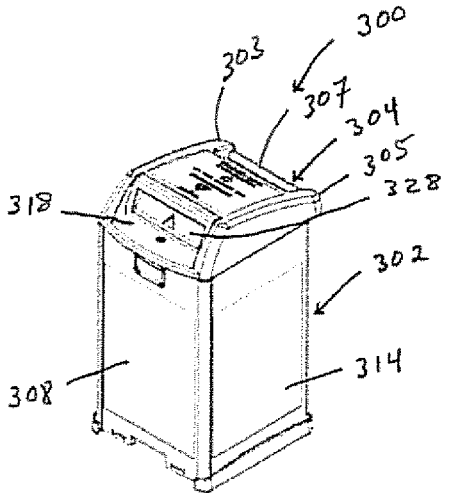
FIG. 8 is a schematic depicting an elevational distal side view of another exemplary document console.
Figure 9:
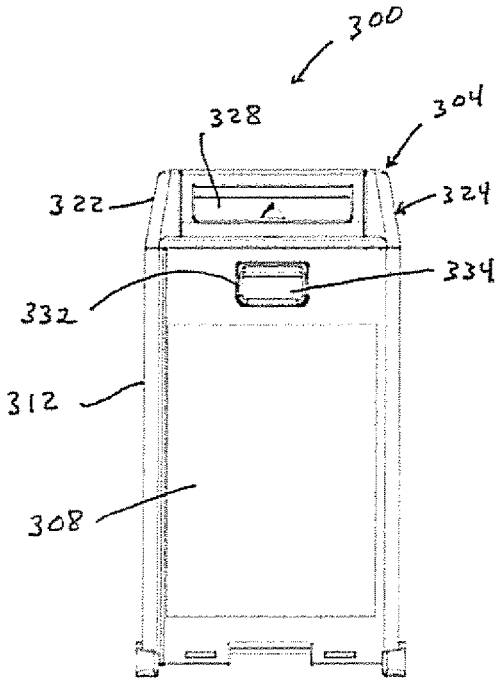
FIG. 9 is a schematic depicting a front side view of the document console shown in FIG. 8.
Figure 10:
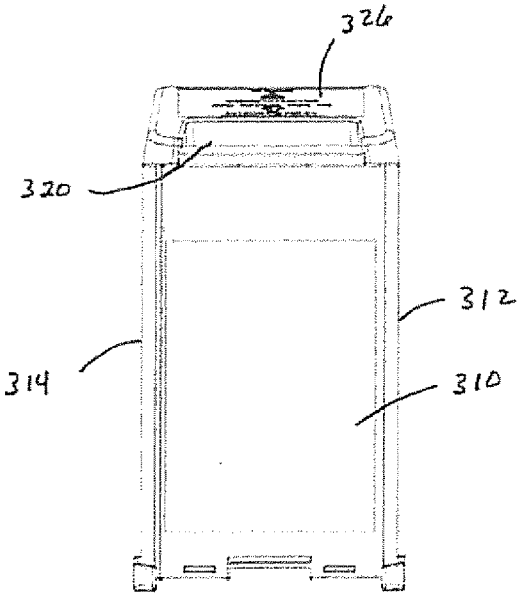
FIG. 10 is a schematic depicting a back side view of the document console shown in FIG. 8.
Figure 14:
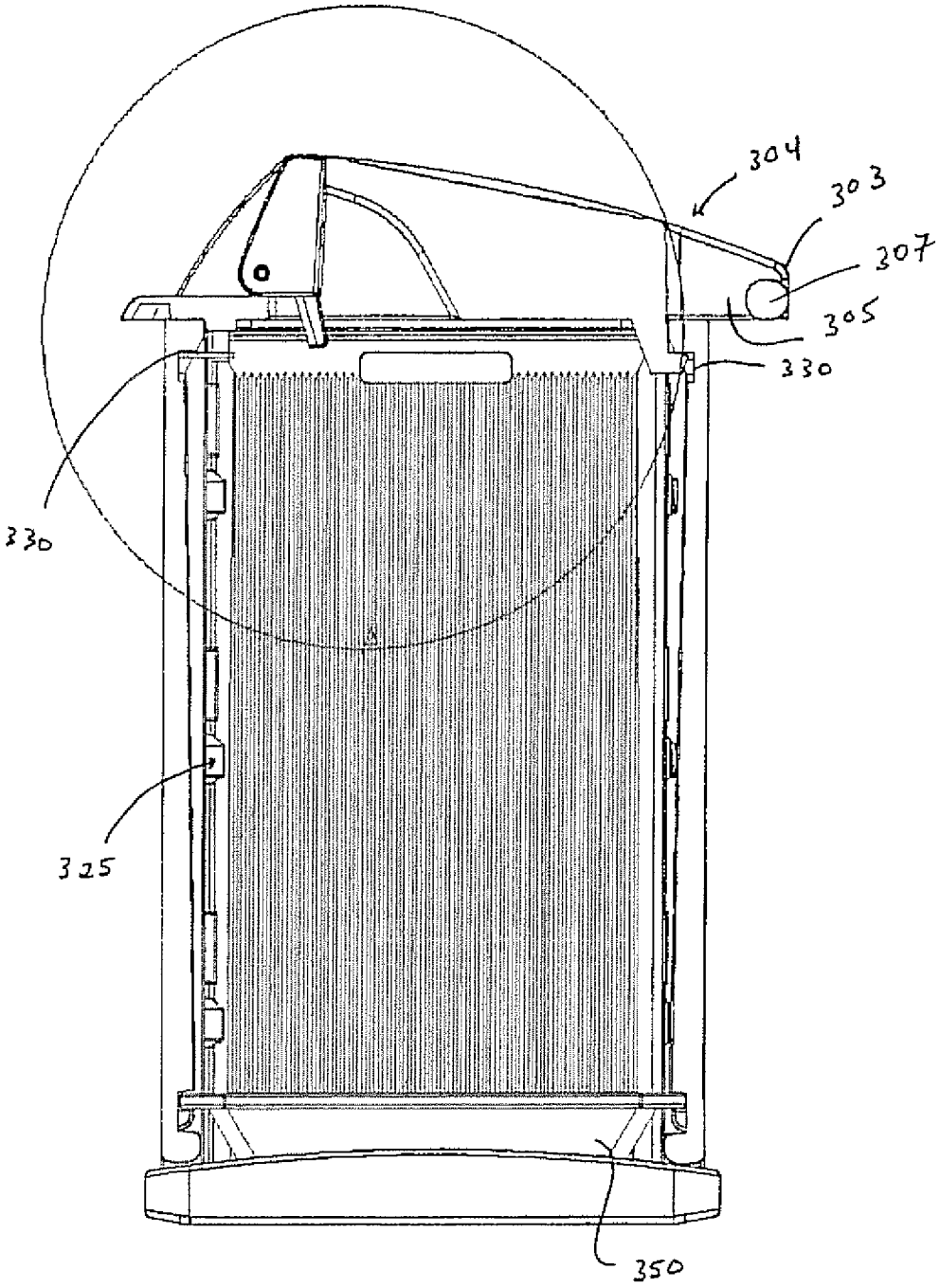
FIG. 14 is a schematic depicting a proximal side view of the document console shown in FIG. 8, wherein a proximal wall of the document console is removed.

Referring to FIGS. 5-7, an exemplary document console 200 comprises a housing 202 having a generally cuboidal configuration having a forward side 204 oppositely situated to a rearward side 206, and a proximal lateral side 208 oppositely situated to a distal lateral side 210. Forward side 204 is pivotally joined to proximal lateral side 208, and is fixedly secured to distal lateral side 210 via a locking mechanism 212. A key (not shown) may be used to fix and unfix distal lateral side 210 to forward side 204.

Housing 202 further comprises a top side 214 joined substantially perpendicularly to, and integrally formed with, rearward side 206, proximal lateral side 208, and distal lateral side 210. Additionally, top side 214, forward side 204, rearward side 206, proximal lateral side 208, and distal lateral side 210 surround a chamber 211.

Each of forward side 204, rearward side 206, proximal lateral side 208, and distal lateral side 210 preferably has a substantially planar exterior directed wall, respectively identified as 216, 218, 220, and 222, such that, e.g., a decal may be disposed on one or more of walls 216, 218, 220, and 222. Top side 214 comprises a longitudinally extending slot 224. A pivotally connected door member 225 is disposed within slot 224.

Document console 200 further comprises a generally cuboidal shaped bin member 226. Bin member 226 has a top side 228 that is secured to a forward side 230 by a key lock 232. Top side 228 further comprises an opening 230 in fluid communication with slot 224 of top side 214 of housing 202. Bin member 224 is contained within chamber 211 of housing 202, and is secured therein by locking mechanism 212.

In an exemplary embodiment, documents may be inserted securely into bin member 226 via slot 224 and opening 230. When it comes time to empty documents to be shredded from bin member 226, an operator need only unlock housing 202, open forward side 204, and remove bin member 226 from chamber 211 via the opening created from opening forward side 204. Bin member 226 may then be unlocked, top side swung open, and the documents removed.

In an exemplary embodiment, housing 202 serves as a cover for bin member 226. A securing member, such as, for example, at least one of a cable, chain, tether, and the like, may be used to keep the cover from being removed from an unauthorized person.

Other exemplary document consoles are depicted in, e.g., FIGS. 8-41 and 43, wherein like numbers refer to like features. Referring to these figures, a document console 300 comprises a housing 302 having a forward panel 308 oppositely situated to a rearward panel 310, and a proximal panel 312 oppositely situated to a distal panel 314. Although they may be formed from a wide variety of materials, in an exemplary embodiment, panels 308, 310, 312, and 314 are formed from plastic. A chamber 316 is formed between forward panel 308, rearward panel 310, proximal panel 312 and distal panel 314.

Each of forward panel 308, rearward panel 310, proximal panel 312, and distal panel 314 respectively comprises a horizontally extending top edge 327, 329, 331 and 333 oppositely situated to a horizontally extending bottom edge 335, 337, 339, and 341. Panels 308, 301, 312, and 314 each further respectively comprises a vertically extending proximal edge 309, 311, 313, and 315, and an oppositely situated vertically extending distal edge 317, 319, 321, and 323. When assembled, panels 308, 310, 312, and 314 are assembled such that top edges 327, 329, 331, and 333 are coplanar with one another and form an opening 346 which leads into chamber 316.

In an exemplary embodiment, each of edges 309, 311, 313, 315, 317, 319, 321, and 323 has either a male or a female mating dovetail system 325 that allows forward panel 308, rearward panel 310, proximal panel 312, and distal panel 314 to be tightly constructed in consecutive order to "snap" together. As shown, e.g., proximal panel 312 connects to rearward panel 310 via dovetail system 325, which connects to distal panel 314 via dovetail system 325. Forward panel 308 may then connect to distal panel 314 and to proximal panel 312 via dovetail system 325. As will be described in greater detail below, this design allows a base member 350 to also be held tightly in place during assembly of document console 300. This system allows console 300 to be shipped efficiently in pieces, and assembled by the customer when needed. The system further reduces storage space and improves shipping, handling, manufacturing, and the like.

Housing 302 comprises features that confer anti-static properties onto console 300 such that the paper documents contained within console 300 may be more easily removed from chamber 316 of console. For example, each of forward panel 308, rearward panel 310, proximal panel 312, and distal panel 314 respectively comprises an interior surface 345, 347, 349, and 351 which is directed towards chamber 316. In an exemplary embodiment, at least one of interior surfaces 345, 347, 349, and 351 has a texturized surface, wherein the texturized surface may include, at least one of e.g., an etched finish, repeated vertical ribs 340 formed from top to bottom (see, e.g., FIG. 14), dimples 342 (see, e.g., FIG. 26), diagonal hashlines 344 (see, e.g., FIG. 25), and the like.

Vertical ribs 340, which may be molded into respective panels 308, 310, 312, and 314, create a plurality of clearly delineated passages for the unimpeded flow of air between the respective interior surfaces and the contents of the console, e.g., the paper contained within the console. Such unimpeded air flow in turn reduces the static electricity generated between the paper contents and interior surfaces 345, 347, 349, and 351 of document console 300, which allows for an easier removal of the paper contents from document console 300. Dimples 342 and diagonal hashlines 344 further reduce surface area, and, therefore, improve airflow between panels 308, 310, 312, and 314 and the contents of document console 300. The etched finish virtually eliminates "smooth" surfaces that can attract receptacle contents (static).

Figure 45:
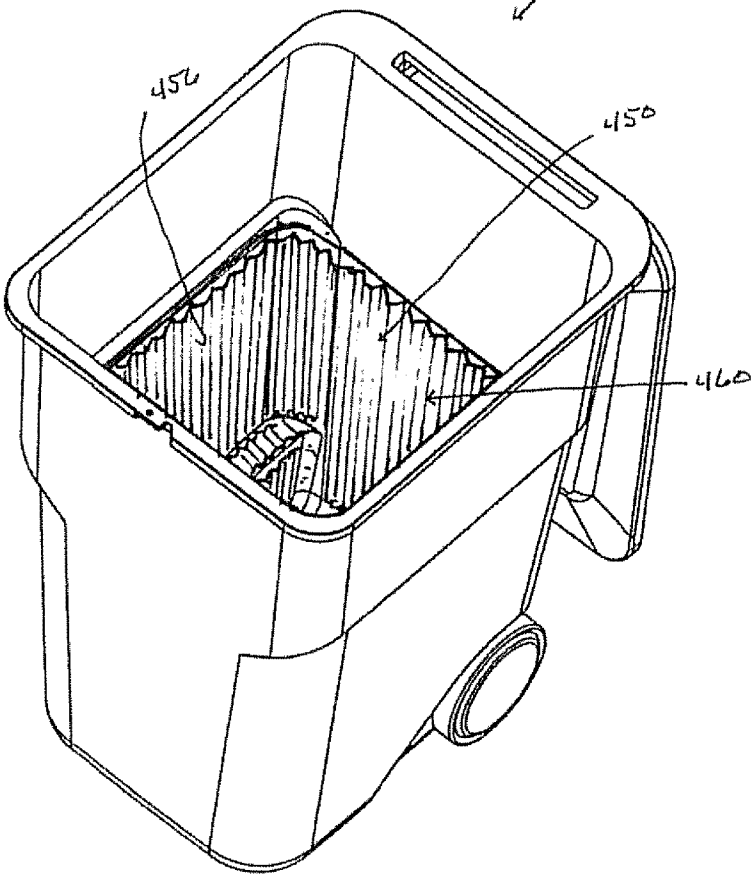
FIG. 45 is a schematic depicting the console depicted in FIG. 44 engaged with the liner depicted in FIG. 44.
Figure 44:
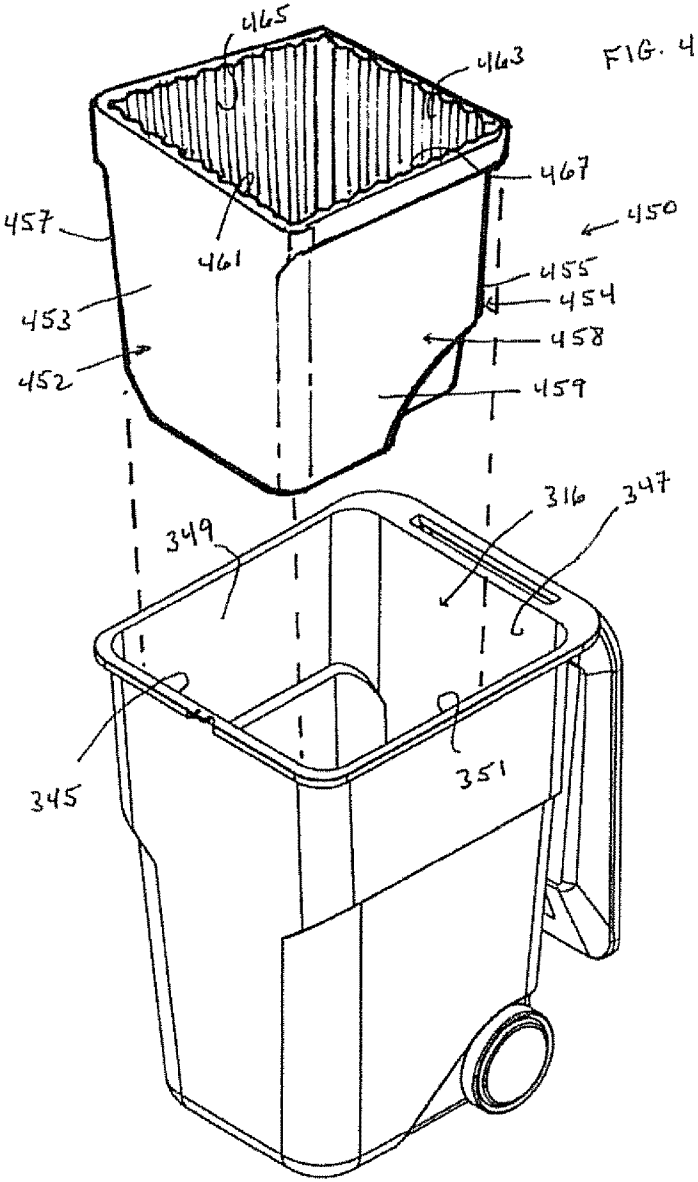
FIG. 44 is a schematic depicting an exemplary console and an exemplary liner, wherein the console and the liner are disengaged with one another.

Referring to FIGS. 44 and 45, in another exemplary embodiment, which is particularly well suited where interior surfaces 345, 347, 349, and 351 have relatively smooth surfaces, document console 300 further includes a liner 450. As shown in the figures, liner 450 is specially contoured to fit against interior surfaces 345, 347, 349, and 351. As shown in FIG. 45, liner 450 may be positioned within chamber 316 and placed immediately adjacent to interior surfaces 345, 347, 349, and 351 such that an exterior side 453 of a forward wall 452 of liner 450 abuts interior surface 345, an exterior side 455 of a rearward wall 454 of liner 450 abuts interior surface 347, an exterior side 457 of a proximal wall 456 of liner 450 abuts interior surface 349, and an exterior side 459 of a distal wall 458 of liner 450 abuts interior surface 351.

In an exemplary embodiment, the liner has a texturized surface such as, e.g., one or more of vertical ribs, dimples, diagonal hashlines, and the like. As shown in FIGS. 44 and 45, interior sides 461, 463, 465, and 467 of respective walls 452, 454, 456, and 458 have a plurality of vertically extending ribs 460 formed thereon.

The liner, which may be formed as an integral unit with the housing of the console, or which may be separately formed therefrom and which, therefore, may be removably attached therefrom, preferably comprises a material that confers anti-static properties between the liner and the paper contents of the console to thereby, in conjunction with the texturized surface and the contoured design of the liner, further facilitate removal of the contents from the console by removing or greatly reducing static force. An exemplary material includes, for example a plastic such as, e.g., polyurethane, polyethylene, and the like. In an exemplary embodiment, the liner may be formed, e.g., by injection molding, thermoforming, and the like.

As the documents cling to the plastic walls of housing 302 due to static electricity and friction, providing a unique design for airflow greatly minimizes the static pressure, allowing papers to more efficiently dump from document console 300. This saves considerable time and effort, and reduces the risk of confidential documents not being properly processed.

The design of document console 300 further facilitates removal of the paper contents contained within document console 300 in that panels 308, 310, 312, and 314 of housing 302 are formed to have about a 1.5 degree draft, thereby causing housing 302 to have a generally conical configuration, wherein an upper portion of console 300. i.e., the portion closer to bottom edges 335, 337, 339, and 341, has a lesser diameter than a diameter of a lower portion of console 300, i.e., the portion closer to top edges 327, 329, 331, and 333. The flow of air created between console 300 and the paper documents is shown, for example, at FIG. 27.

Figure 27:
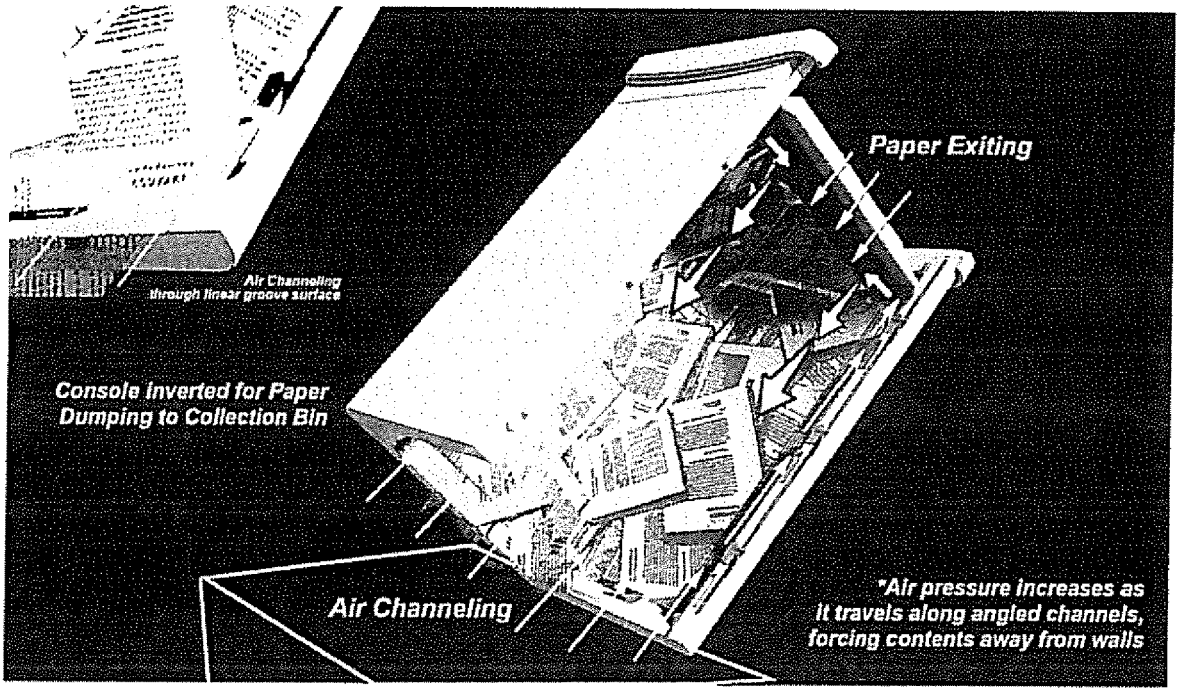
FIG. 27 is a schematic depicting the flow of air through a document console.
Figure 28:
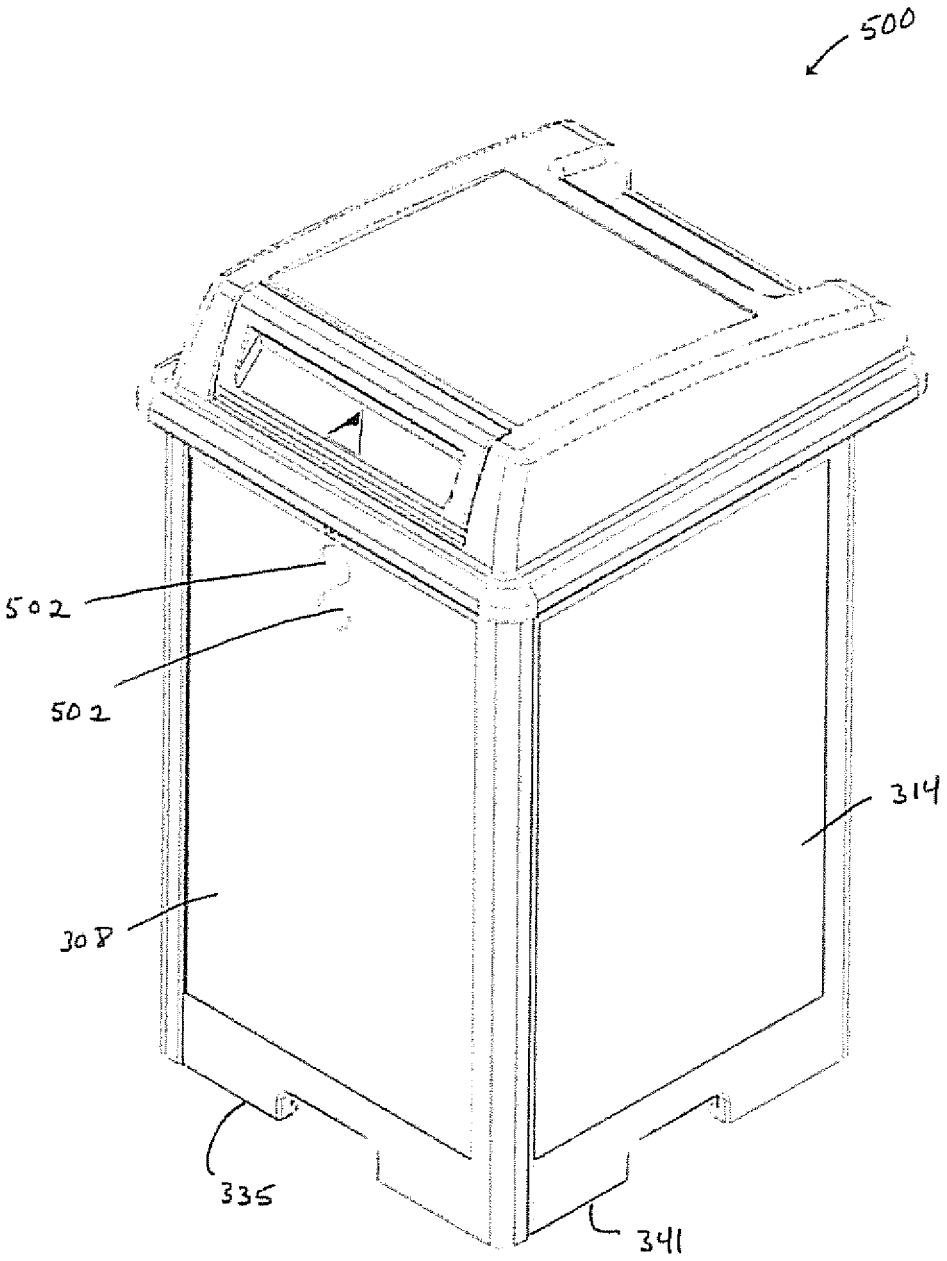
FIG. 28 is a schematic depicting an elevational distal side view of another exemplary document console.
Figure 29:
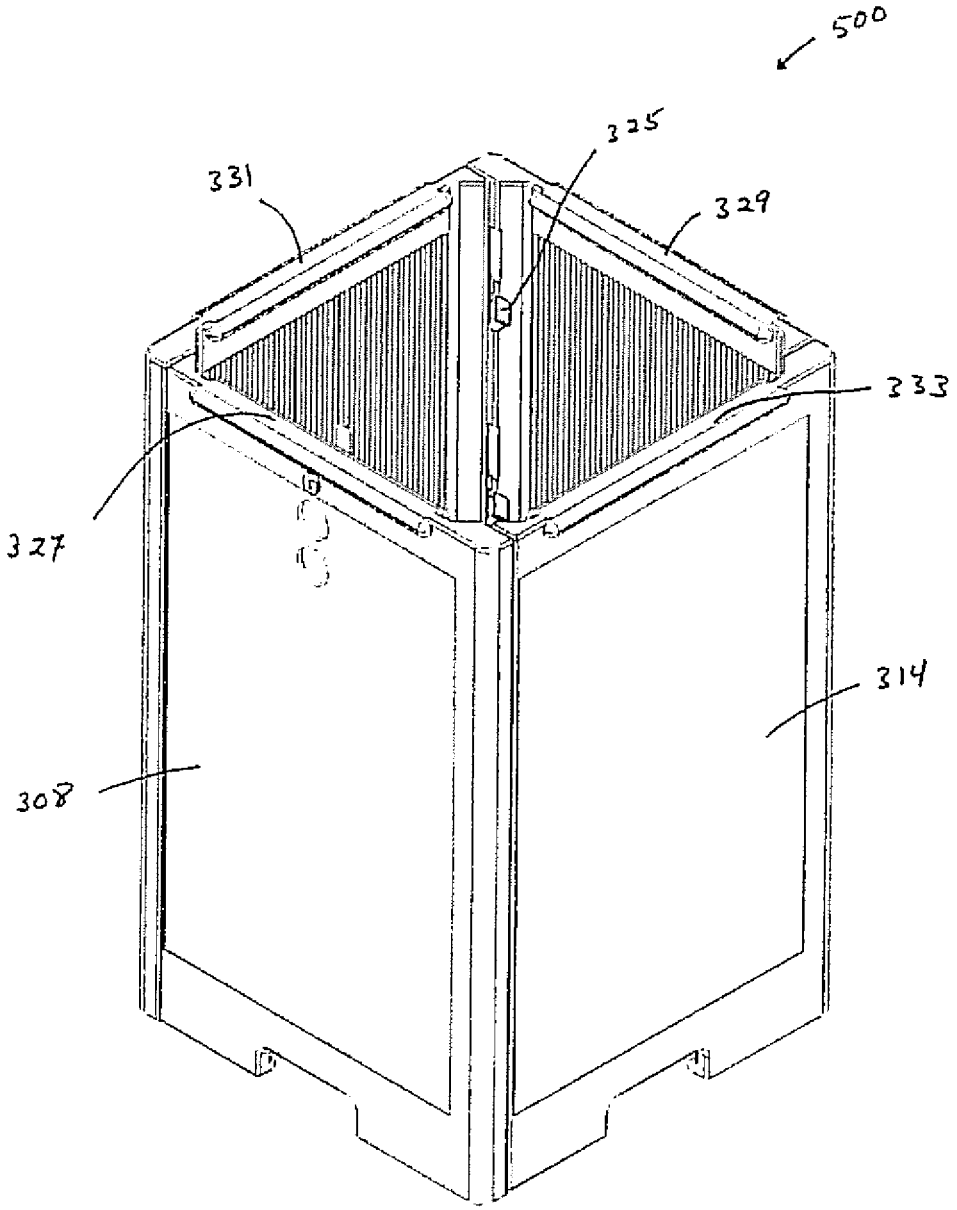
FIG. 29 is a schematic depicting the document console shown in FIG. 28, wherein an upper member of the console is removed.
Figure 30:
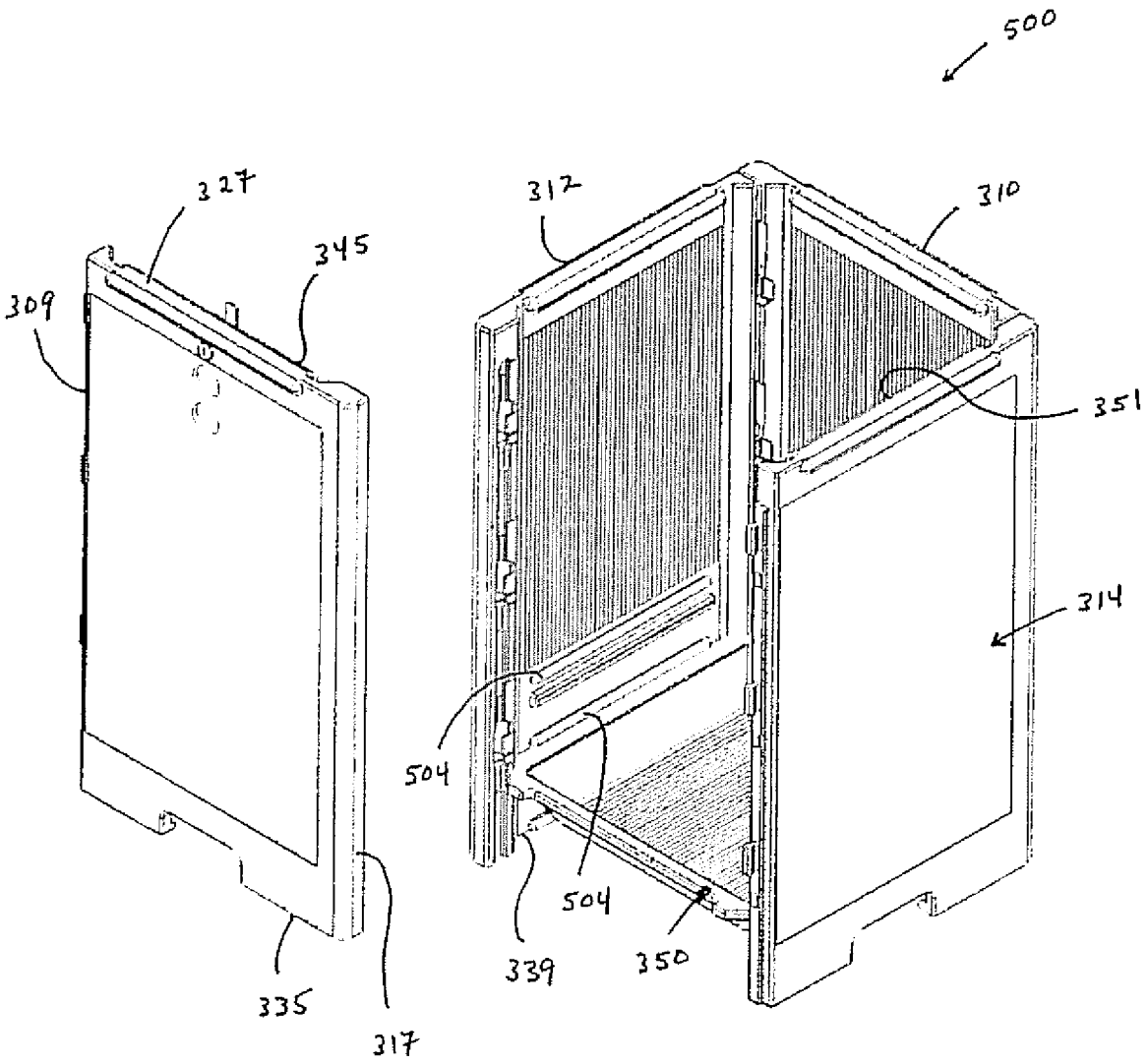
FIG. 30 is a schematic depicting the document console shown in FIG. 29, wherein the forward panel of the housing is removed.
Figure 31:
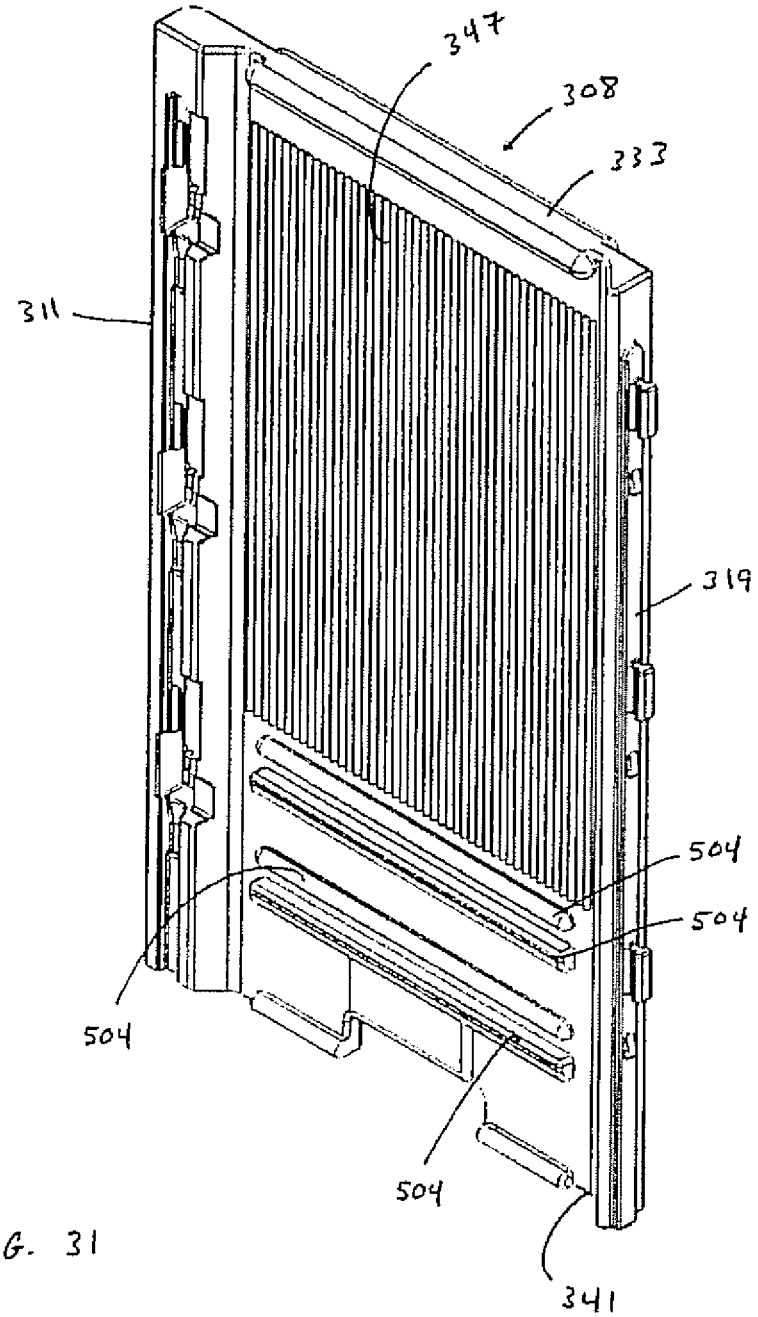
FIG. 31 is a schematic depicting a rearward panel of the document console shown in FIG. 28.
Figure 32:
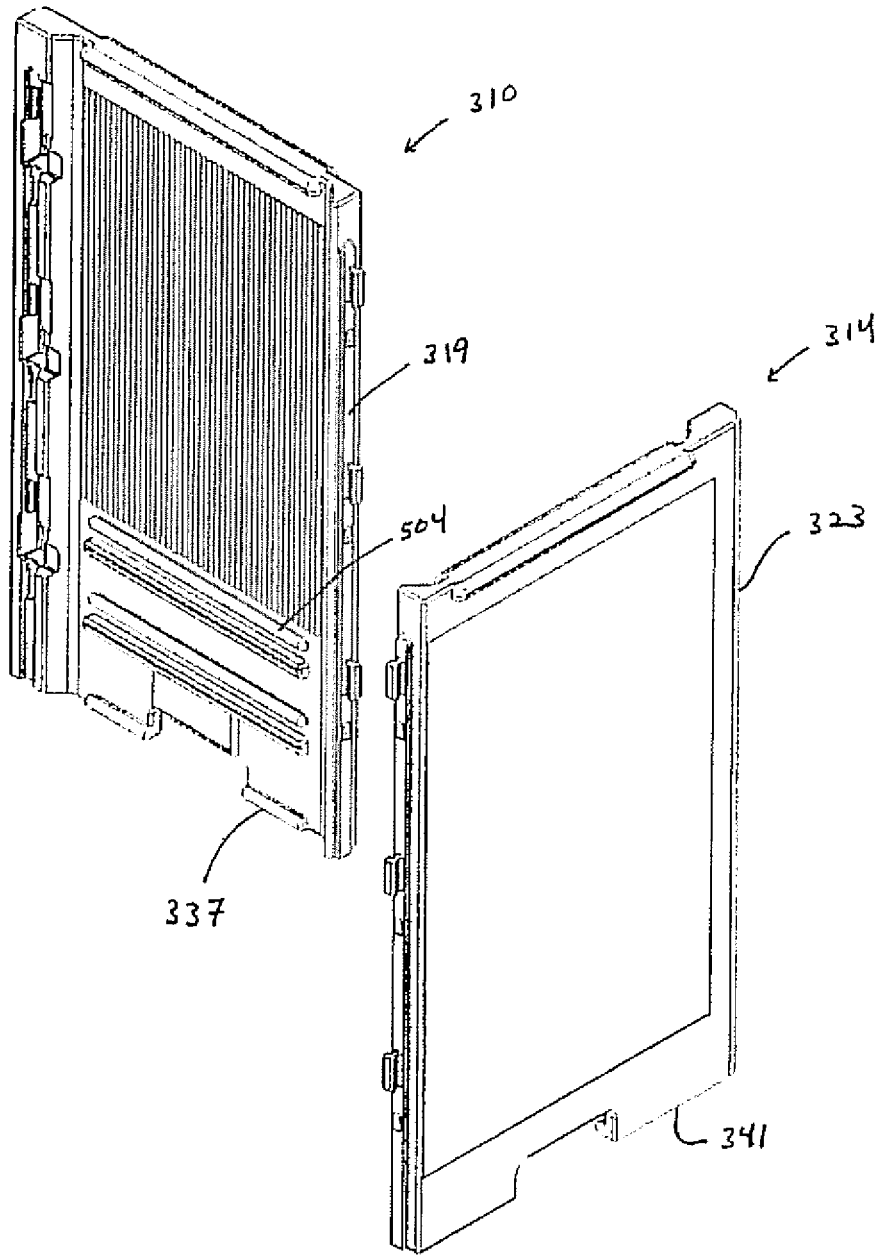
FIG. 32 is a schematic depicting a distal panel disconnected from the rearward panel of the document console shown in FIG. 28.
Figure 33:
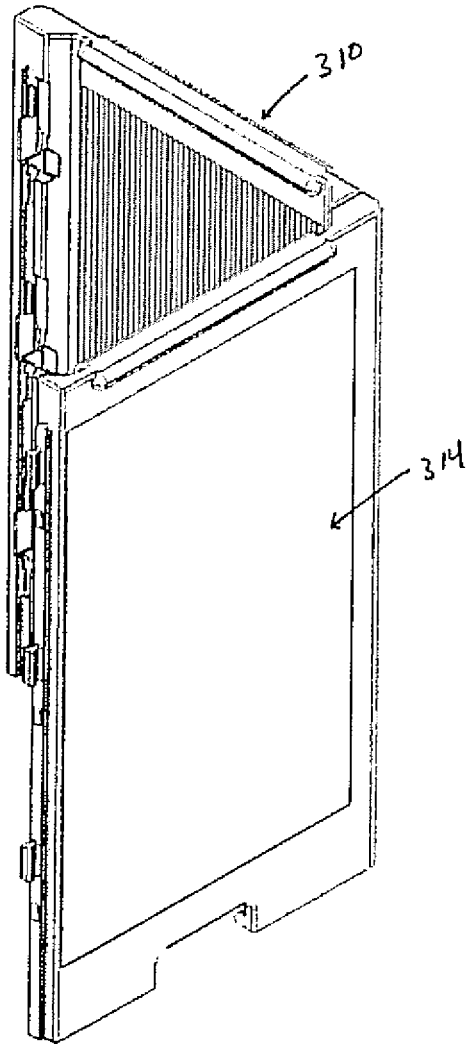
FIG. 33 is a schematic depicting the distal panel shown in FIG. 32 connected to the rearward panel shown in FIG. 32.
Figure 34:
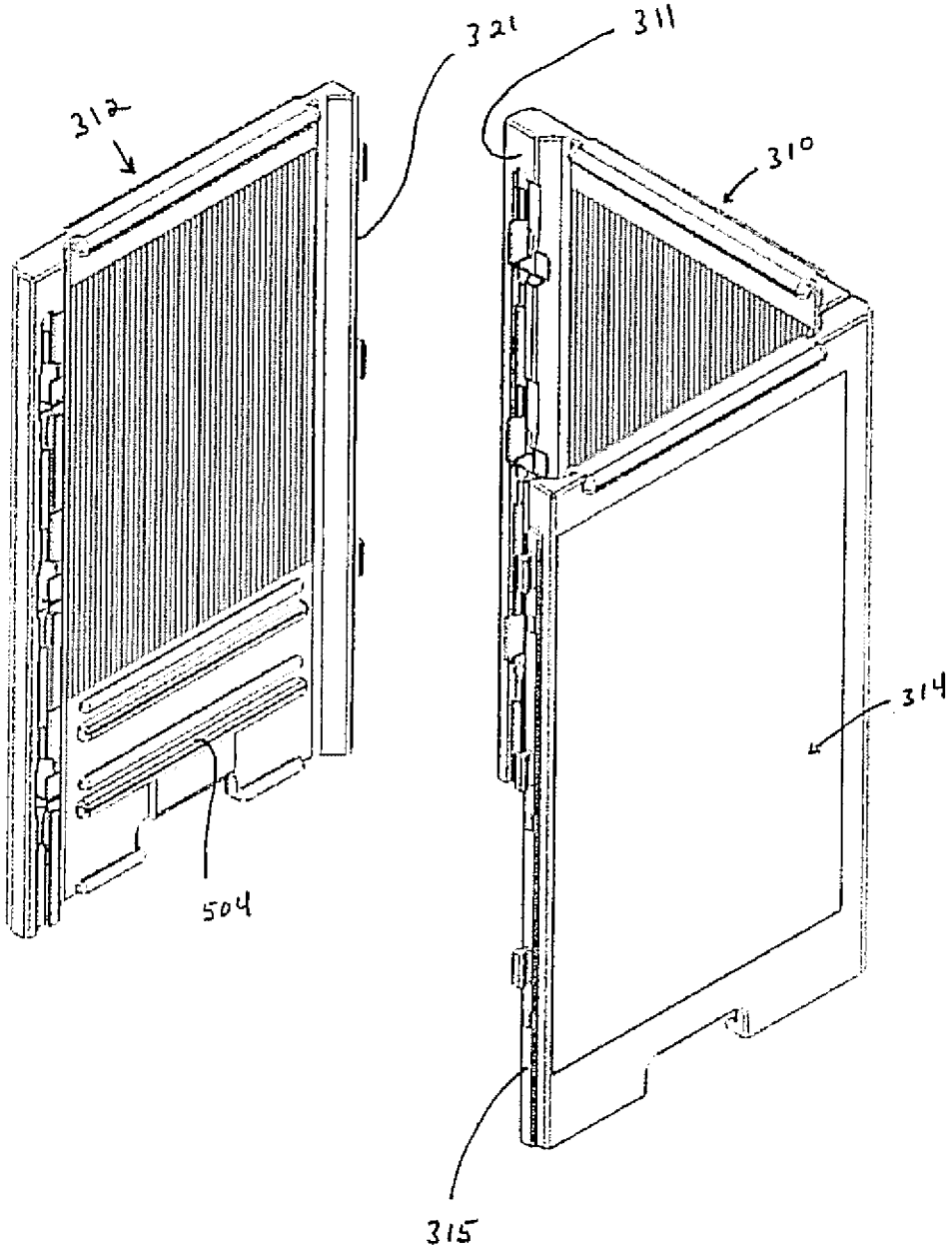
FIG. 34 is a schematic depicting a proximal panel disconnected from the connected distal panel and rearward panel shown in FIG. 33.
Figure 35:
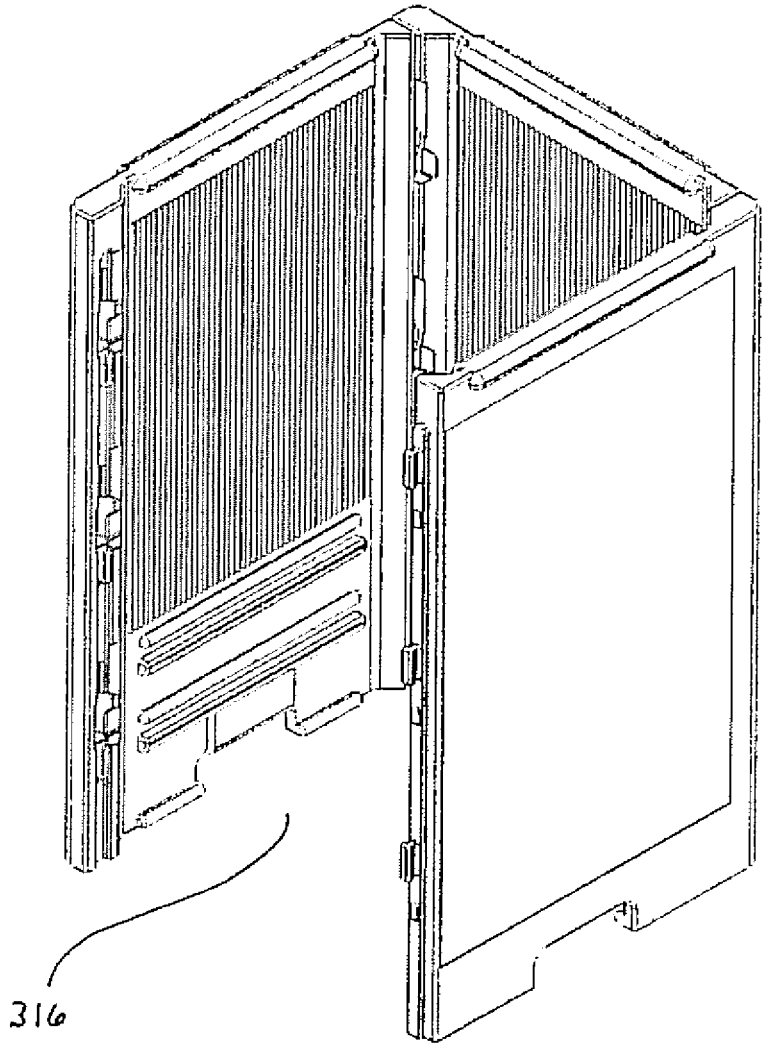
FIG. 35 is a schematic depicting the proximal panel connected to the distal panel and the rearward panel, all as shown in FIG. 34.
Figure 36:
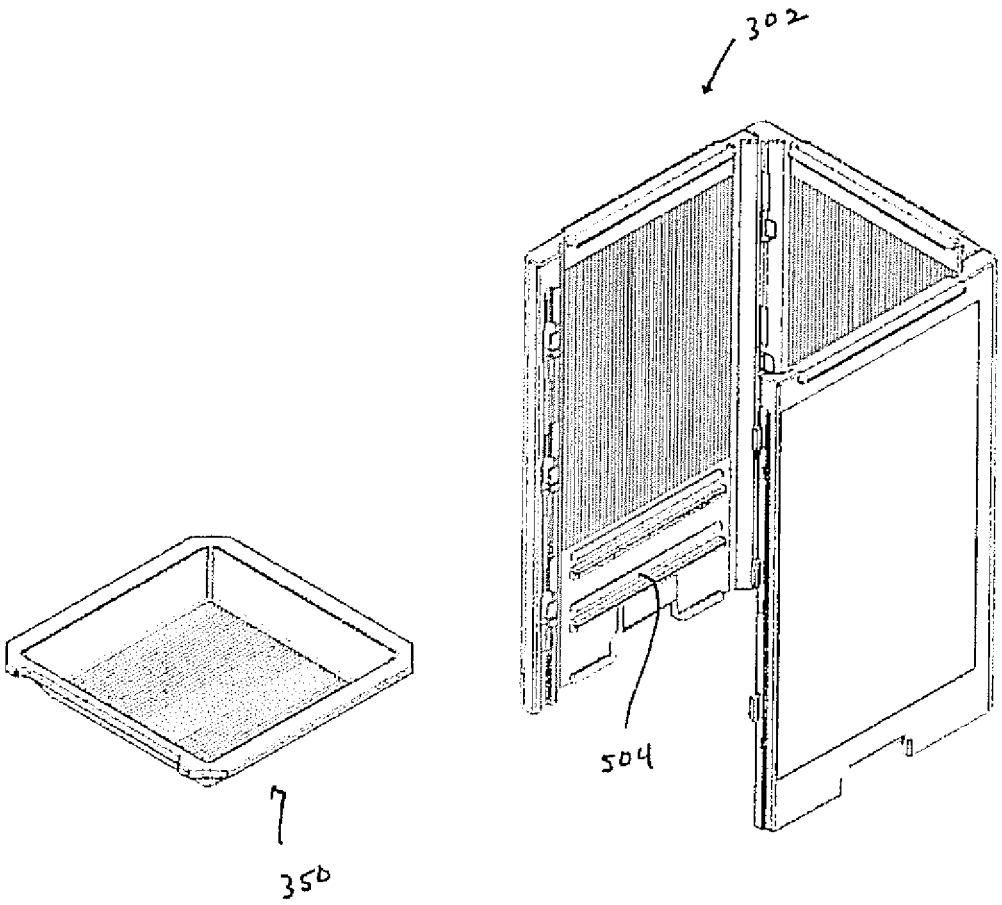
FIG. 36 is a schematic depicting the console shown in FIG. 35 and an exemplary base member.
Figure 37:
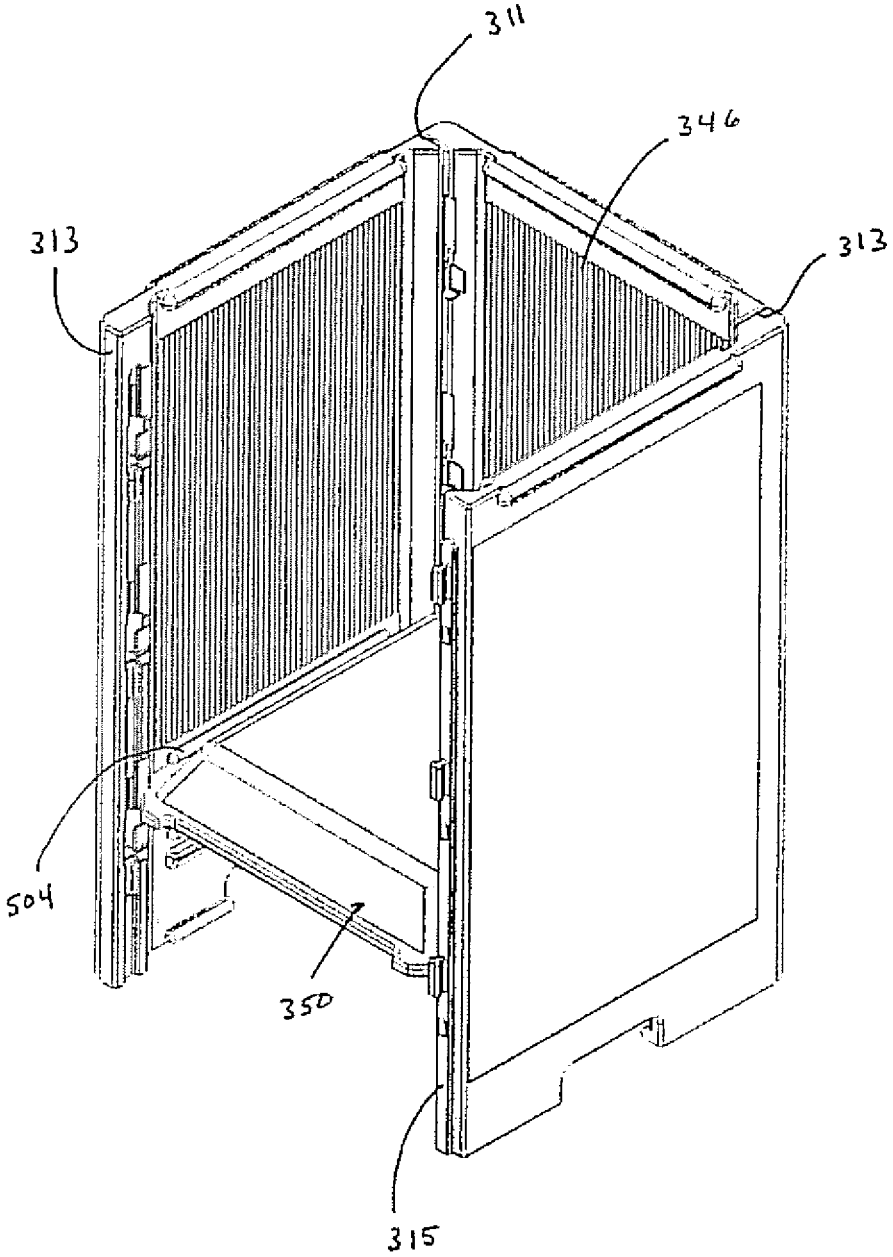
FIG. 37 is a schematic depicting the console shown in FIG. 36, wherein the base member is attached to the proximal and distal panels and to the rearward panel.
Figure 38:
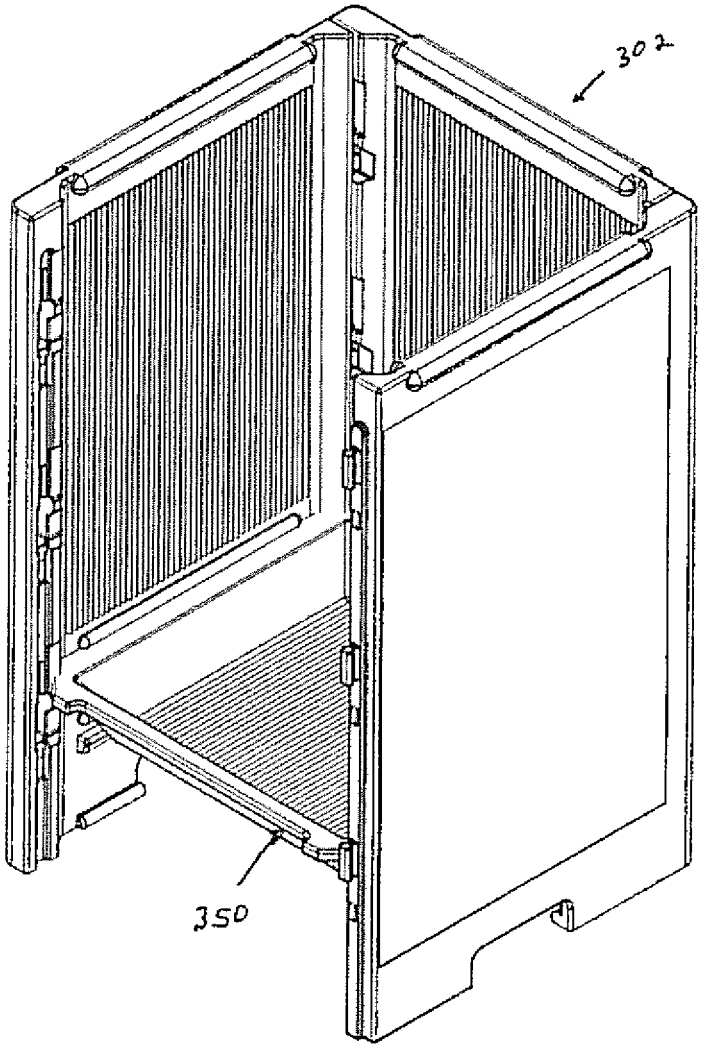
FIG. 38 is a schematic depicting the console shown in FIG. 36, wherein the base member is attached in a different position to the proximal and distal panels and to the rearward panel as compared to the position shown in FIG. 37.
Figure 39:
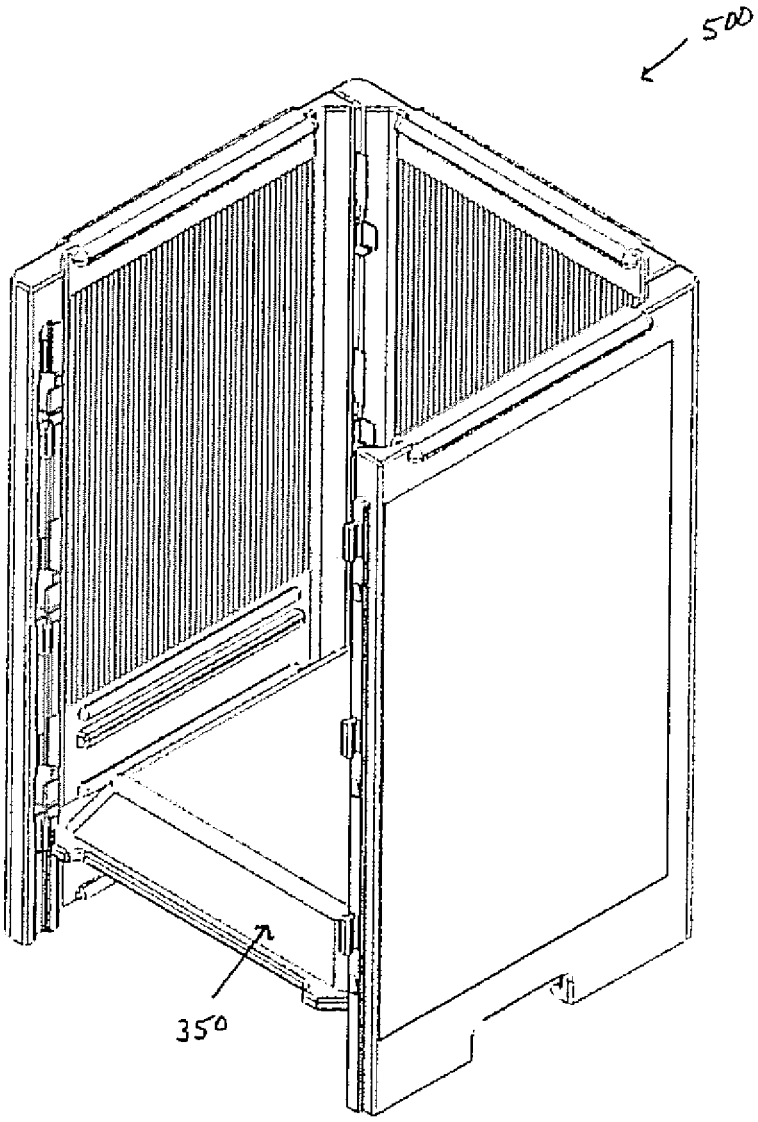
FIG. 39 is a schematic depicting the console shown in FIG. 36, wherein the base member is attached in a different position to the proximal and distal panels and to the rearward panel as compared to the position shown in FIGS. 37 and 38.
Figure 40:
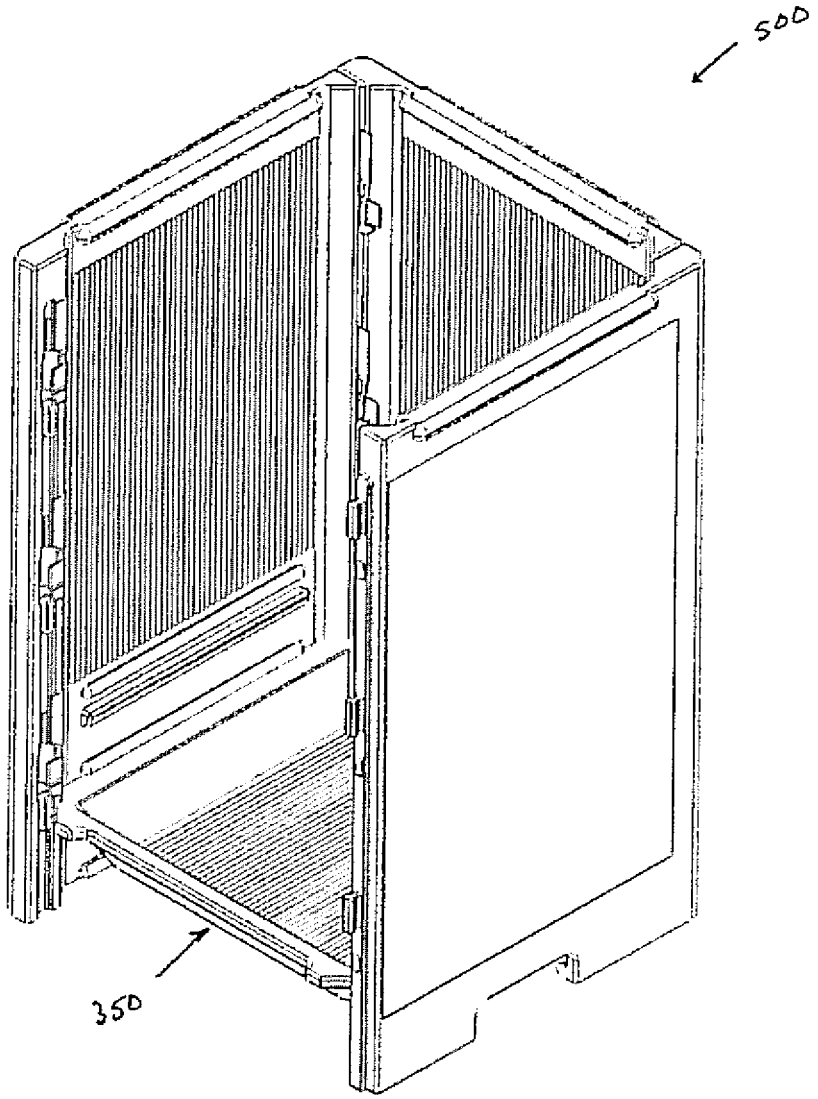
FIG. 40 is a schematic depicting the console shown in FIG. 36, wherein the base member is attached in a different position to the proximal and distal panels and to the rearward panel as compared to the position shown in FIGS. 37-39.

As shown in FIG. 27, as a full document console 300 is lifted and tipped upside down to transfer the contents to a consolidating receptacle, air rapidly replaces the moving documents by channeling up the ribbed walls, which are not obstructed by the contents. The air is compressed at a geometrically progressive rate, as the base area (now towards the top) gets smaller and smaller over each inch the air travels. As the air movement reaches the solid base (again now towards the top) the compressed air pushes the contents downward. The additional dimples and textures reduce surface areas, further reducing surface tension, increasing airflow, and further improving expeditious unit processing.

Document console 300 further comprises an upper member 304 disposed over top edges 327, 329, 331, and 333 and which covers opening 346. Upper member 304 comprises a forward side 318 oppositely situated to a rearward side 320, and a proximal side 322 oppositely situated to a distal side 324. Forward side 318 is aligned with and joined to top edge 327 of forward panel 308, rearward side 320 is aligned with and joined to top edge 329 of rearward panel 310, proximal side 322 is aligned with and joined to top edge 331 of proximal panel 312, and distal side 324 is aligned with and joined to top edge 333 of distal panel 314. Oppositely situated terminal ends of rearward side 320 extend away from distal rearward side 320 to respectively form a flange 303 and a flange 305. A longitudinally extending bar 307 is disposed between flanges 303 and 305 and is secured thereto. Bar 307 serves as a handle by which document console 300 can be grasped and moved. Upper member 304 further comprises a top side 326 joined to forward side 318, rearward side 320, proximal side 322, and distal side 324.

Figure 15:
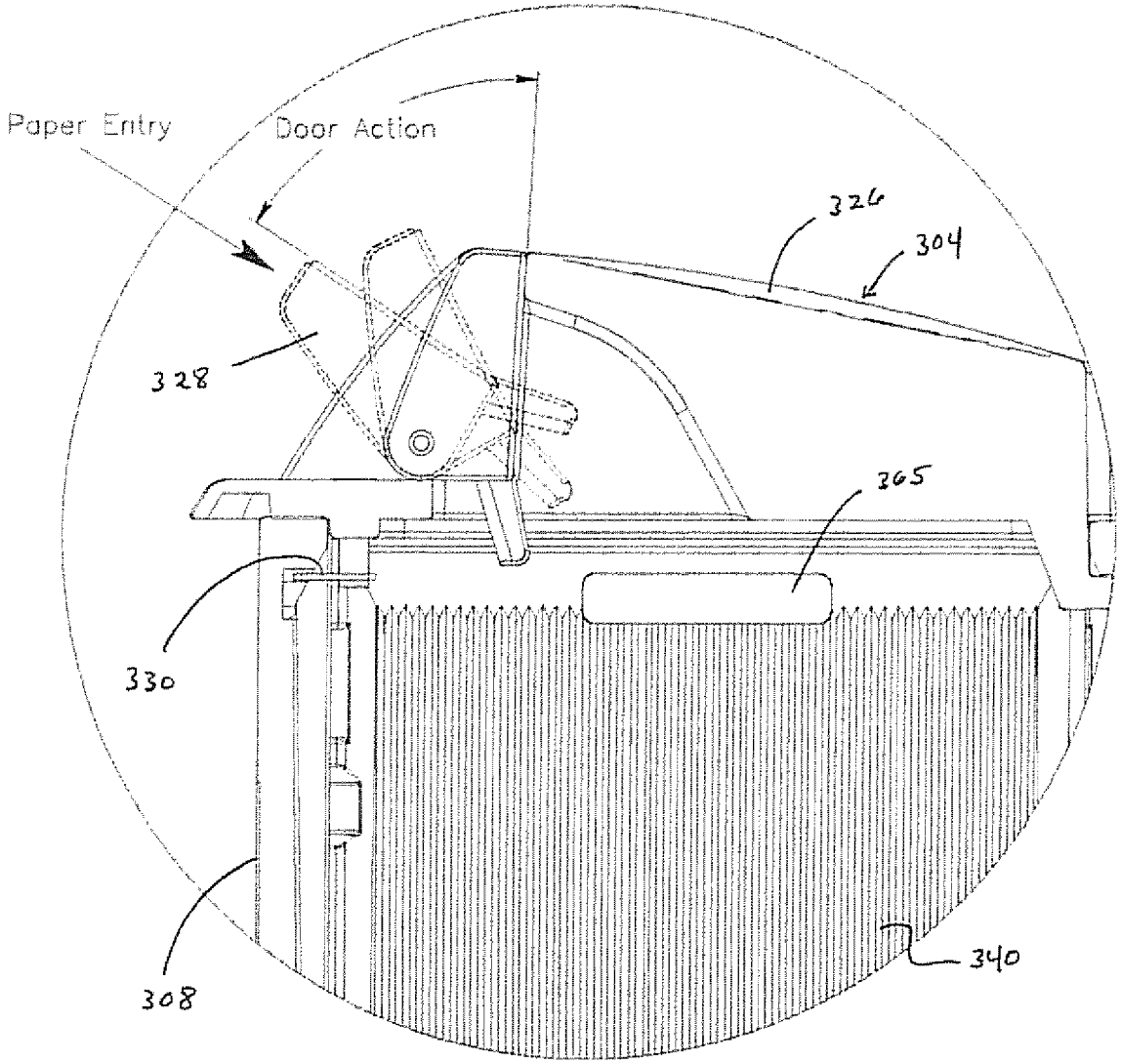
FIG. 15 is a schematic depicting movement of an exemplary access door of the document console shown in FIG. 8.

As best shown in FIG. 15, forward side 318 has a hinged door 328 attached thereto, wherein hinged door 328 provides access into a chamber 325 which is surrounded by top side 326, forward side 318, rearward side 320, proximal side 322, and distal side 324 of upper member 304 and which leads into chamber 316 of housing 302.

Forward wall 308 of housing 302 has an opening 332 formed therethrough into which a window 334 is positioned. In an exemplary embodiment, window 334 comprises a transparent plastic that may be molded into opening 332. Window 334 is formed to allow a user to see how full chamber 316 is, and to also ensure that the contents contained within chamber 316 cannot be read. Therefore, in addition to maintaining the confidentiality of the documents contained within document console 300, window 334 assists a driver in determining how full document console 300 is without having to open console 300. This, thereby saves the driver a considerable amount of time as the driver can determine prior to opening document console 300 if in fact document console 300 needs to be serviced, i.e., if the contents need to be removed from document console 300 at the visit.

Upper member 304 is secured and locked to housing 302 with a locking device to deter unauthorized access. An exemplary locking mechanism 330 for locking upper member 304 to housing 302 is depicted, e.g., in FIGS. 14 and 15. When it comes time to remove the documents contained within chamber 316 of document console 300, upper member 304 is unlocked, and is, thereby disengaged from forward wall 308, rearward wall 310, proximal wall 312, and distal lateral wall 314, and the documents contained within chamber 316 may then be removed from document console 300.

Any one or more of forward side 318, 320, proximal side 322, and distal side 324 of upper member and/or of forward panel 308, rearward panel 310, proximal panel 312, and distal panel 314 may have a handle 365 molded in or attached thereto (see, e.g., FIGS. 15, 20, 25, and 26) wherein handle 365 is preferably formed to be ergonomic, and further wherein handle 365 assists the driver in dumping the documents contained within chamber 316.

Figure 16:
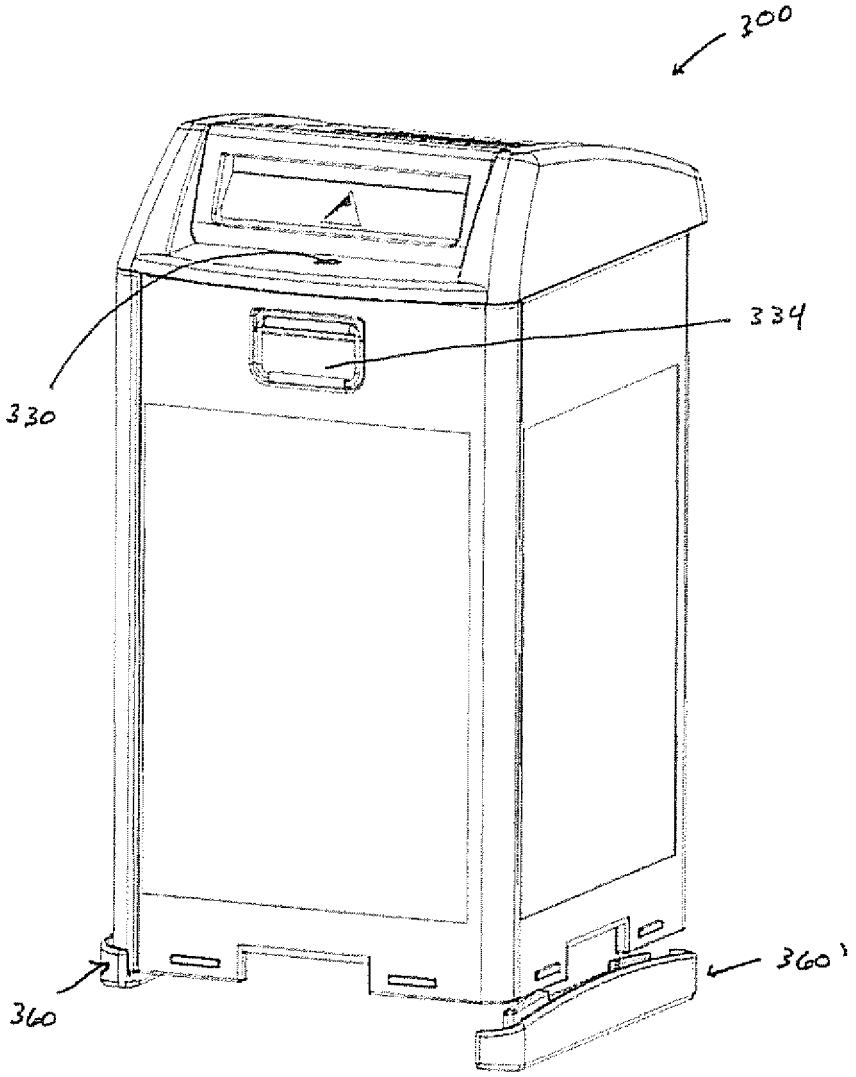
FIG. 16 is a schematic depicting removability of an exemplary foot from the document console shown in FIG. 8.
Figure 17:
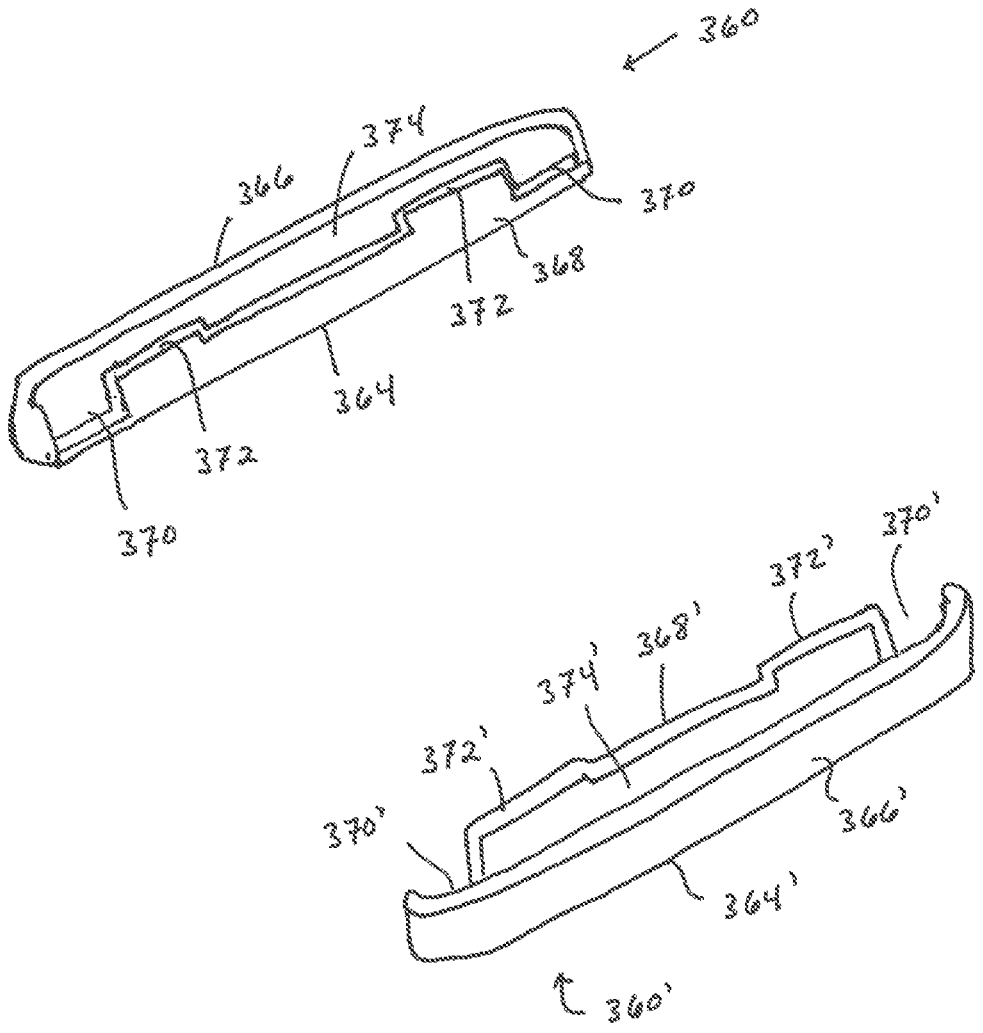
FIG. 17 is a schematic depicting an exemplary type of feet.

As shown in FIGS. 16 and 17, document console 300 may further comprise a foot 360 and a foot 360'. Each of foot 360 and 360' respectively comprises a longitudinally extending body 362 and 362'. Each of bodies 362 and 362' respectively comprises a bottom side 364 and 364' which respectively turns upwards into a distal lateral wall 366 and 366' on one side thereof, and upwards into a proximal lateral wall 368 and 368' on an opposite side thereof. Each of distal lateral walls 366 and 366' are continuously formed, while each of proximal lateral walls 368 and 368' have a pair of slots 370 and 370' respectively formed therein, and a pair of flanges 372 and 372'. Wells 374 and 374' are respectively formed through bodies 362 and 362'.

As shown in FIG. 16, bottom edge 339 of proximal panel 312 is received within well 374 of foot 360, and pair of flanges 372 is received within a pair of slots 376 formed through proximal panel 312. Bottom edge 341 of distal panel 314 is received within well 374' of foot 360', and pair of flanges 372' is received within a pair of slots 376' formed through distal panel 314.

Figure 18:
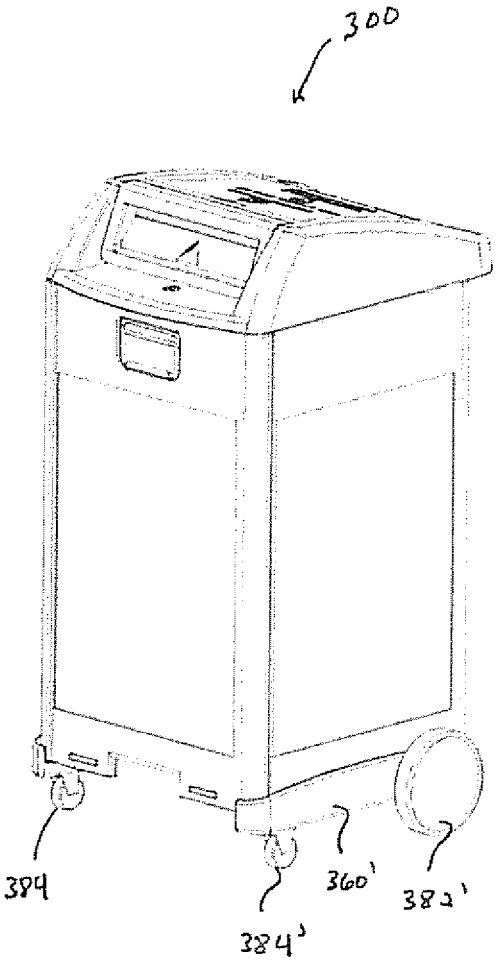
FIGS. 18 and 19 are schematics depicting the document console shown in FIG. 8 fitted with another type of exemplary feet, wherein such feet may include wheels and/or casters.
Figure 19:
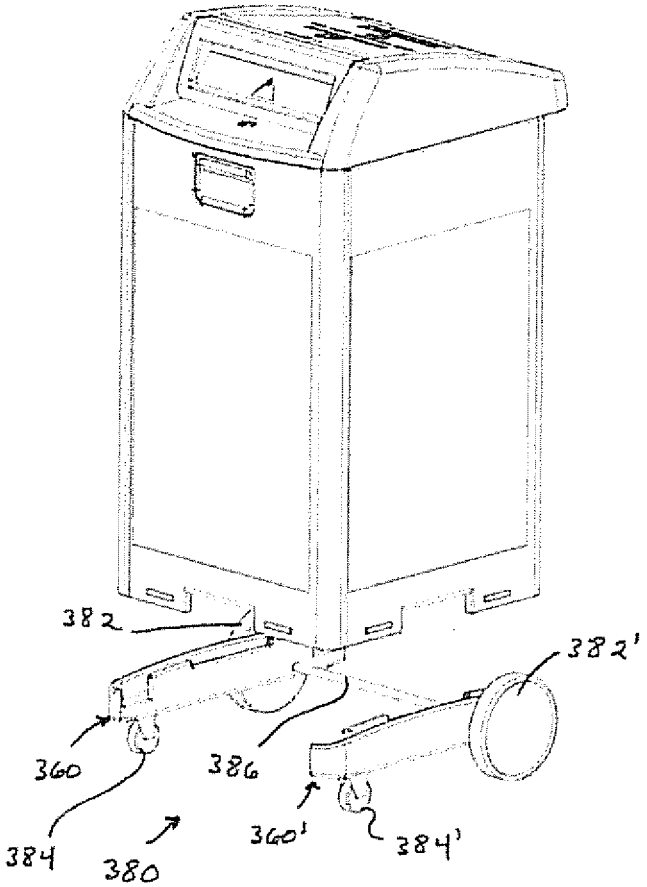
Figure 20:
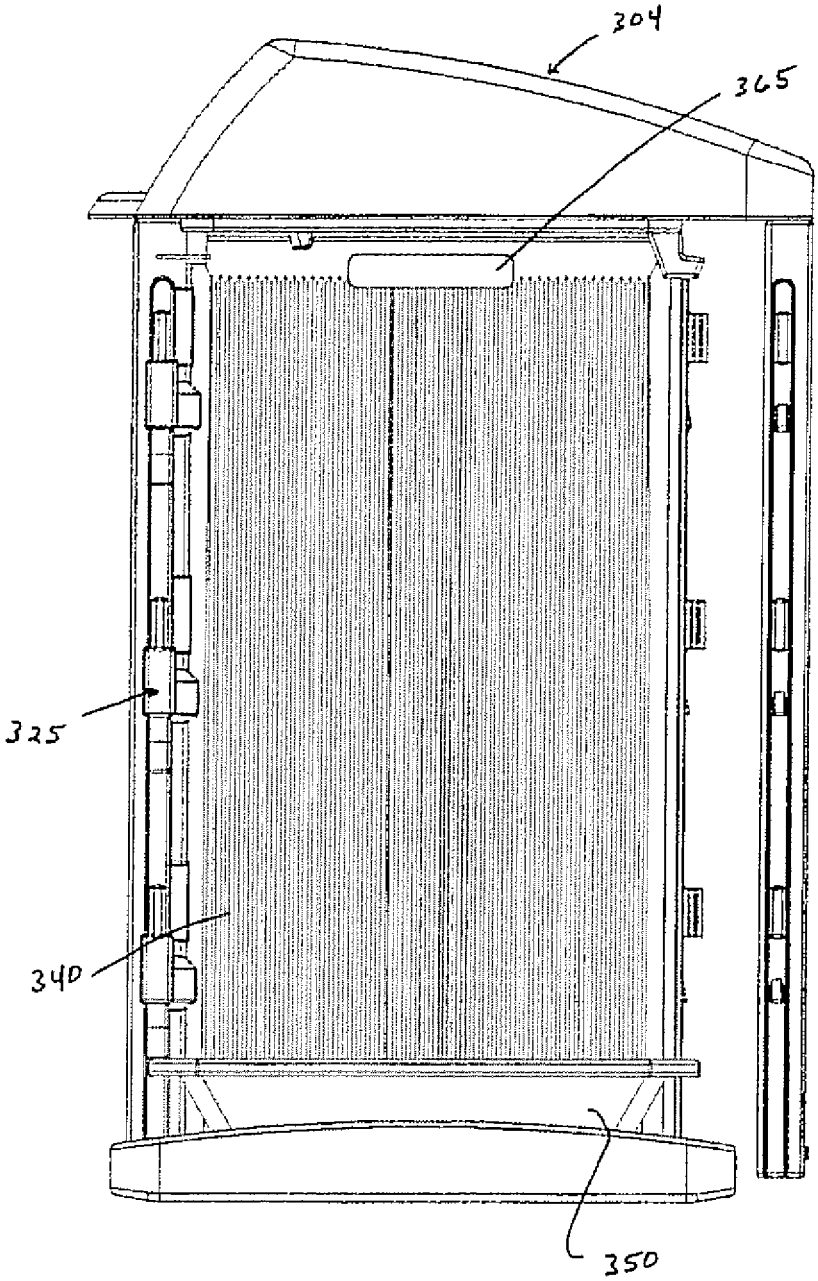
FIG. 20 is a schematic depicting a proximal side of the document console shown in FIG. 8, wherein the proximal wall is removed and wherein the console is shown as further comprising an exemplary base.
Figure 21:
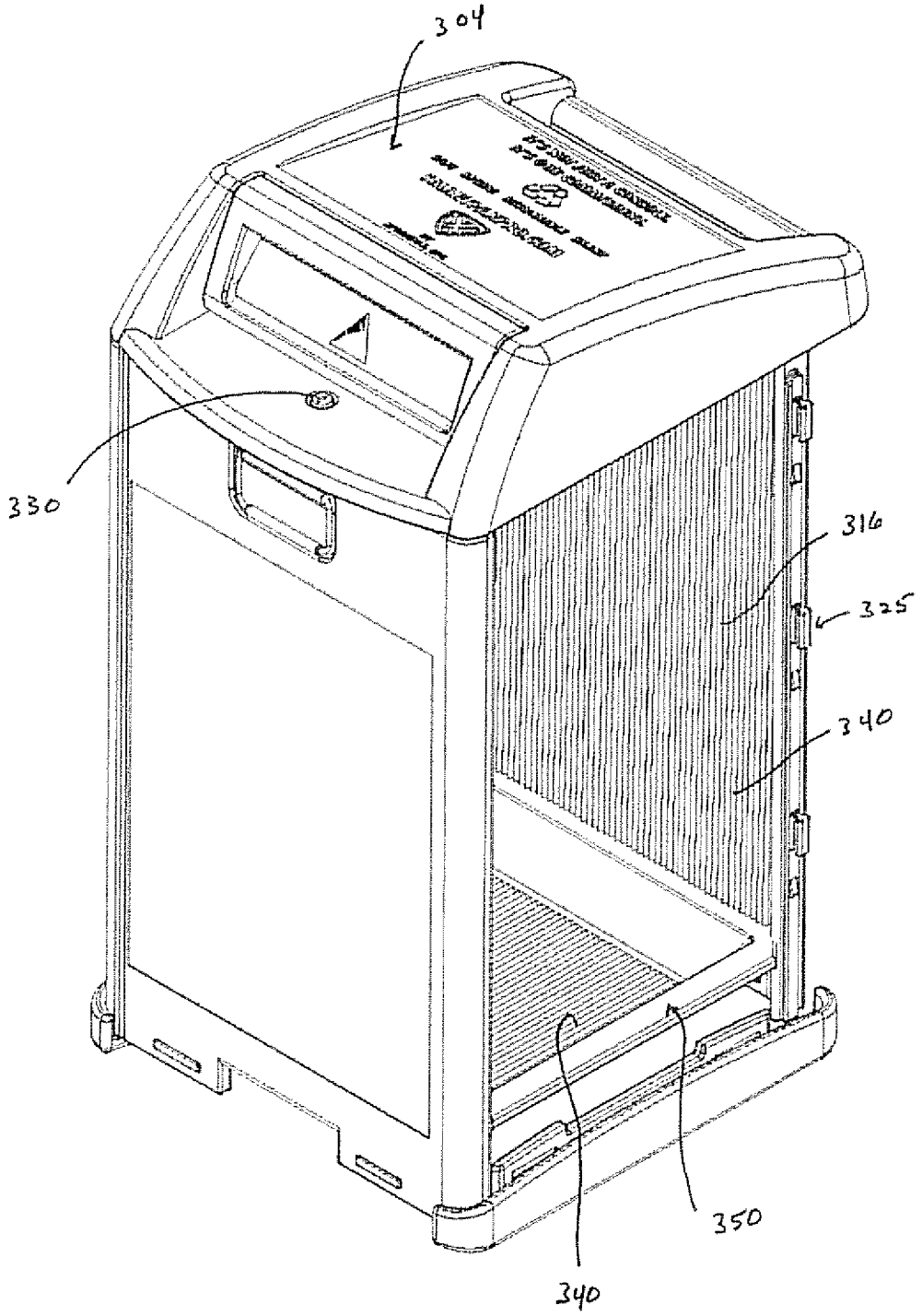
FIG. 21 is a schematic depicting the document console shown in FIG. 8, wherein the distal wall is removed and further showing the base shown in FIG. 20.

Referring to FIGS. 18 and 19, in another exemplary embodiment, document console 300 may include a caster assembly 380. In this embodiment, caster assembly 380 includes feet 360 and 360' in addition to a rearward directed wheel 382 attached to foot 360, a rearward directed wheel 382' attached to foot 360', a forward directed wheel 384 attached to foot 360, and a forward directed wheel 384' attached to foot 360'. Assembly 380 further includes a rod 386 which connects foot 360 to foot 360'. Assembly 380 may be attached to document console 300 in a manner that is substantially identical to that described above for the attachment of feet 360 and 360' to document console 300.

Figure 22:
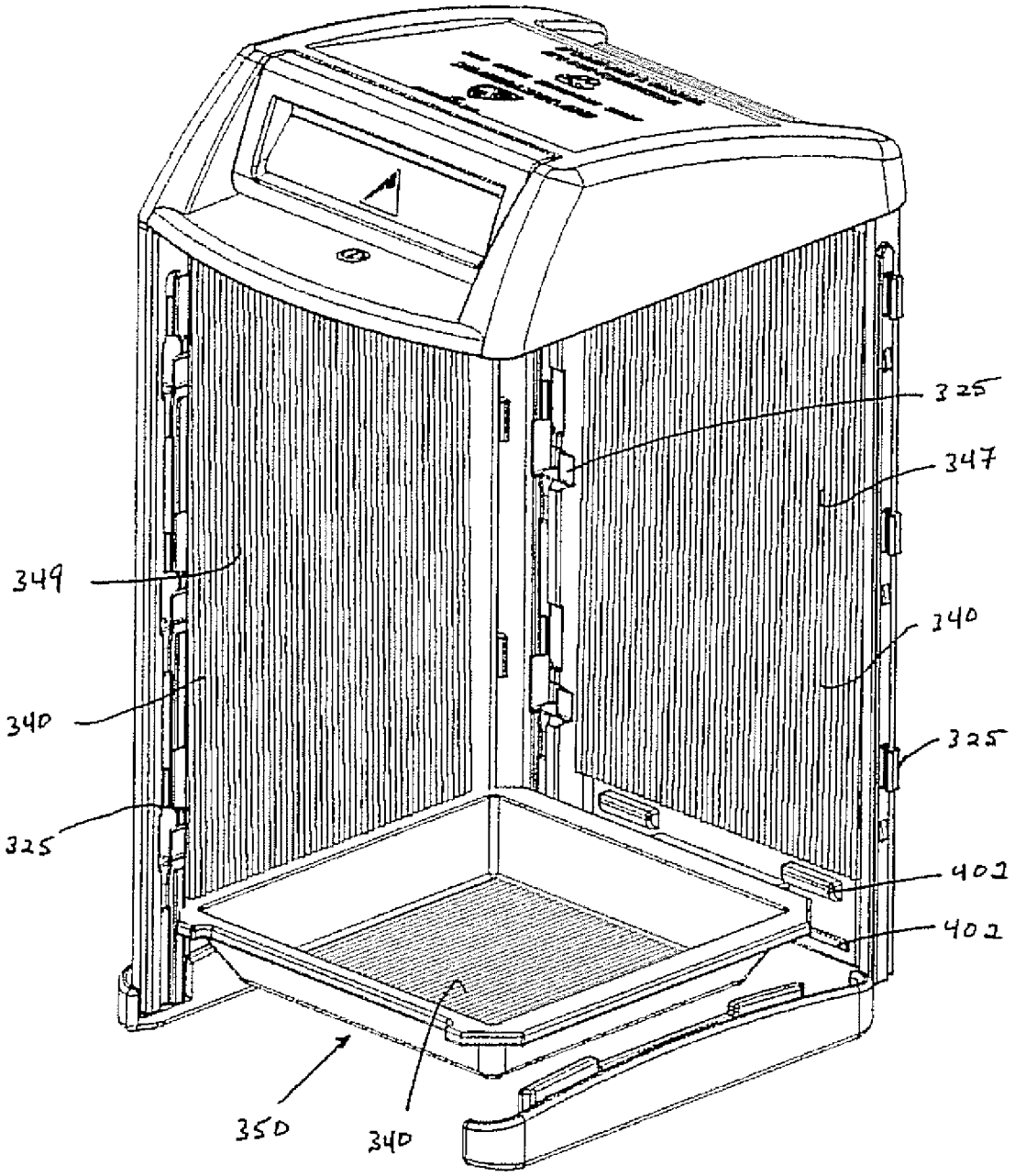
FIG. 22 is a schematic depicting the document console shown in FIG. 8 having the front and distal walls removed and further showing the base shown in FIG. 20 wherein the base is not fully attached to a housing of the console.
Figure 23:
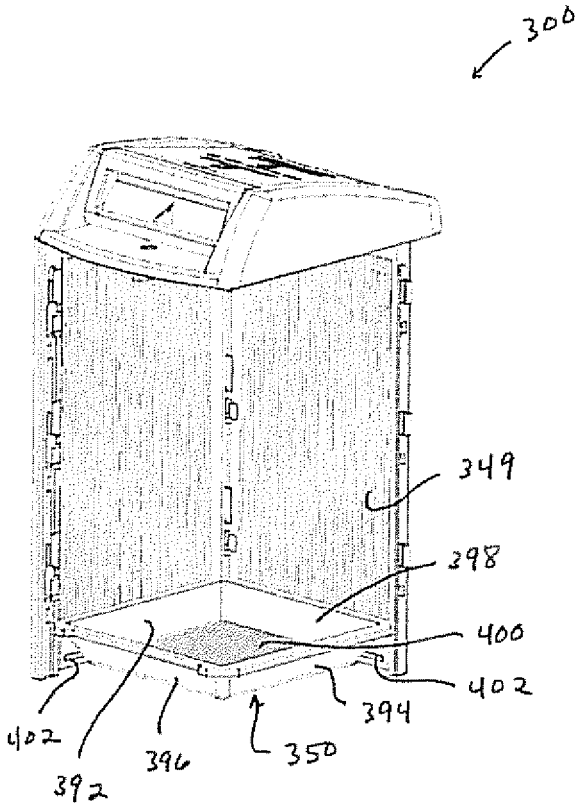
FIG. 23 is a schematic depicting the document console shown in FIG. 20, wherein the base is attached to a portion of the housing of the console.
Figure 24:
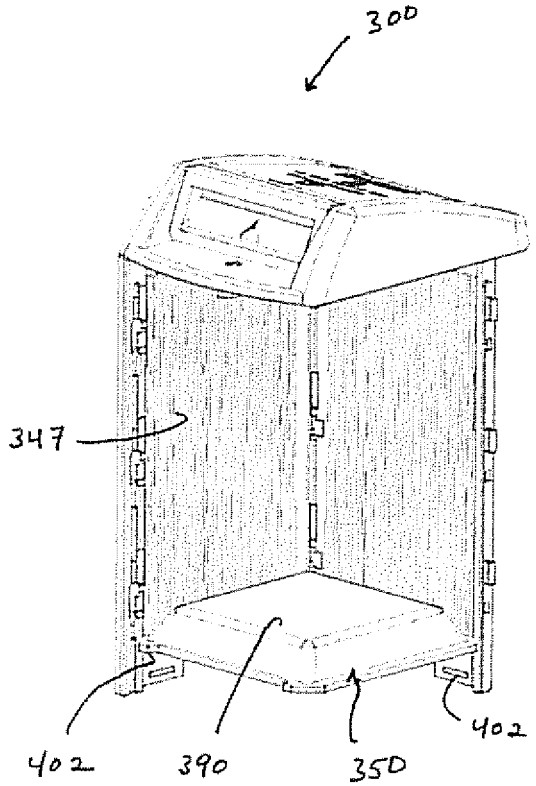
FIG. 24 is a schematic depicting the document console shown in FIG. 23, wherein the base is inverted within a portion of the housing.
Figure 25:
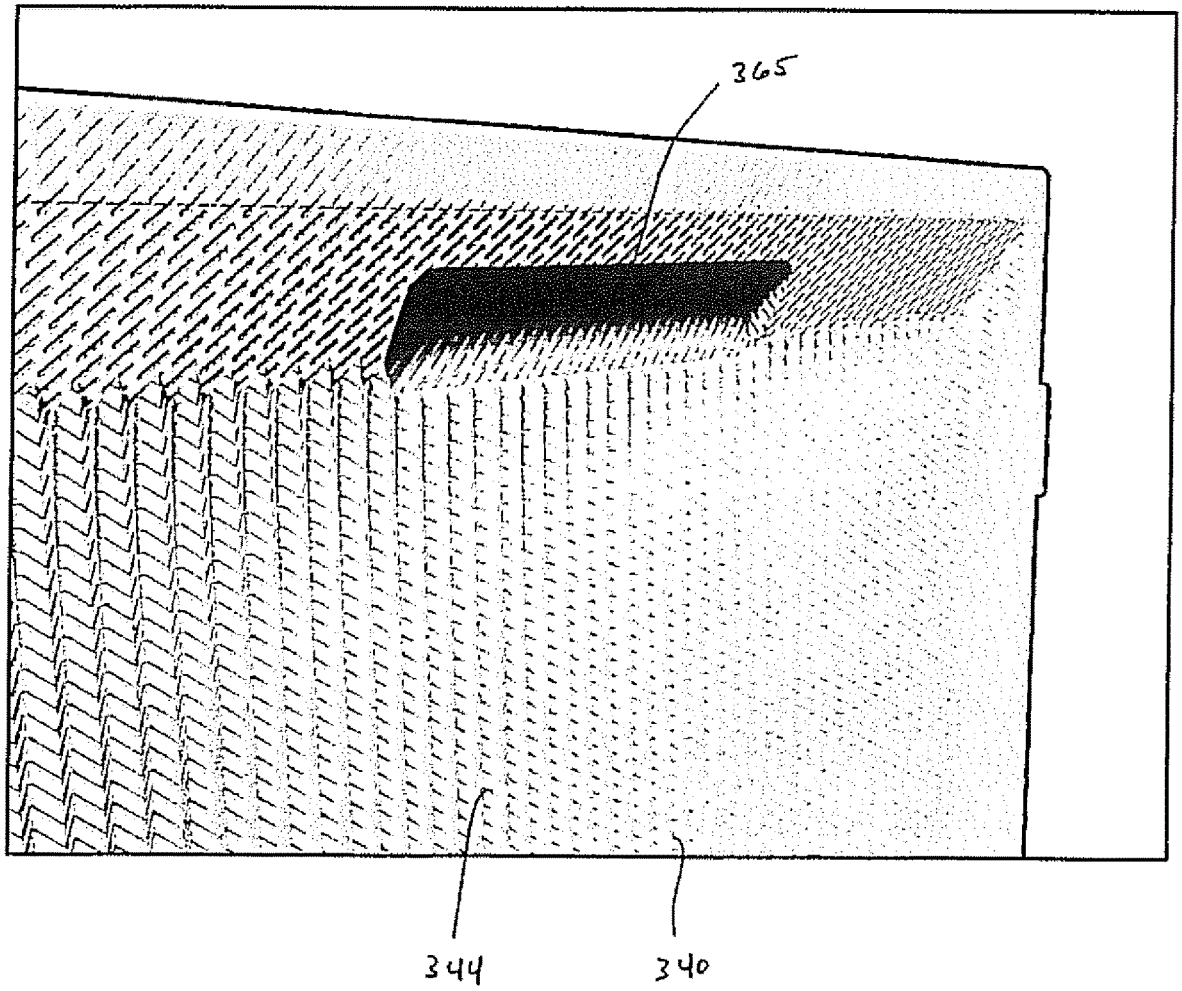
FIG. 25 is a schematic depicting exemplary textured interior side walls of the document console.
Figure 26:
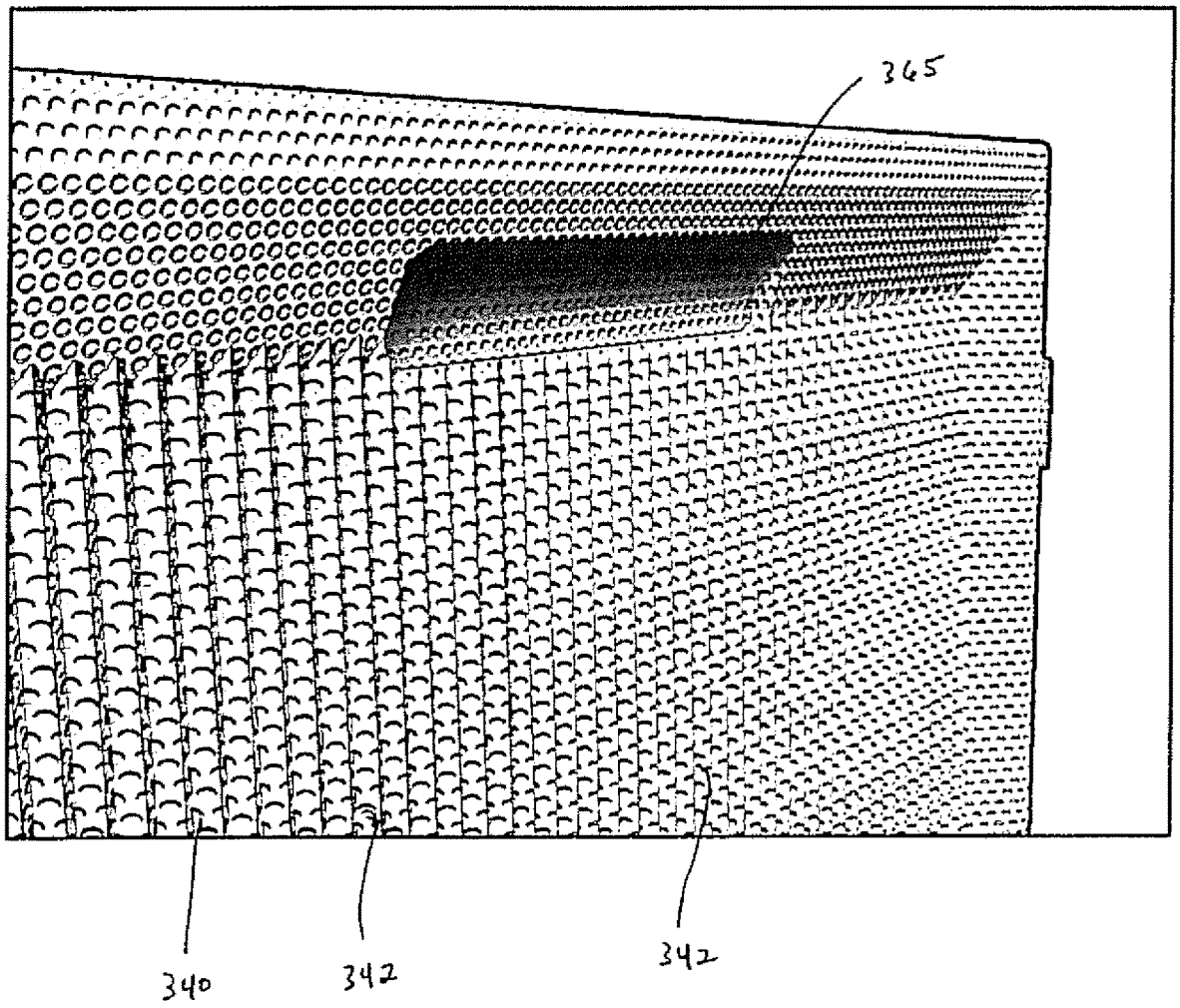
FIG. 26 is a schematic depicting exemplary textured interior side walls of the document console.

Referring to FIGS. 21-24, document console 300 further comprises a base member 350. Base member 350 comprises a bottom side 390, a proximal side 392 oppositely situated to a distal side 394, and a forward side 396 oppositely situated to a rearward side 398, wherein sides 392, 394, 396, and 398 are contiguously formed with and are raised relative to bottom side 390. As shown in FIG. 22, an interior surface 400 of bottom side 390 may have a textured surface as described above for housing 302. Alternatively, a liner as described above may be formed to be fitted on interior surface 400.

Lower portions of interior surfaces 345, 347, 349, and 351 have tabs 402 formed thereon wherein tabs hold base member 350 into place. As shown, e.g., in FIG. 24, tabs 402 further secure base member 350 into position even when base member 350 is inverted. Such inversion may be desired where a user wishes to decrease the holding capacity of document console 300.

FIGS. 28-41 and 43 depict another document console 500. Document console 500 is substantially identical to console 300 with a few exceptions as set forth below, wherein like numbers used to describe console 500 are substantially identical to the numbers used to describe console 300. A forward panel 308 of console 500 comprises a plurality of circular shaped windows 502. Windows 502 assist a user in determining whether document console 500 is full, and is, therefore, ready for emptying.

Furthermore, interior surfaces 345, 347, 349, and 351 of respective forward panel 308, rearward panel 310, proximal panel 312, and distal panel 314 has a series of horizontally extending tabs 504 formed thereon, wherein tabs 504 receive base member 350 such that the position of base member 350 within chamber 316 is adjustable.

Figure 41:
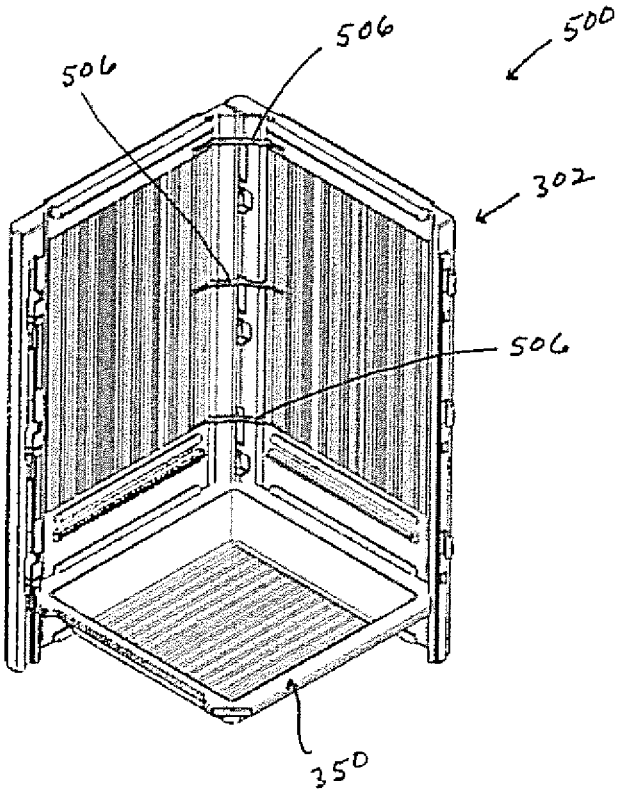
FIG. 41 is a schematic depicting an exemplary document console, wherein the panels of the console are further secured to one another via a plurality of corner gussets.
Figure 42:
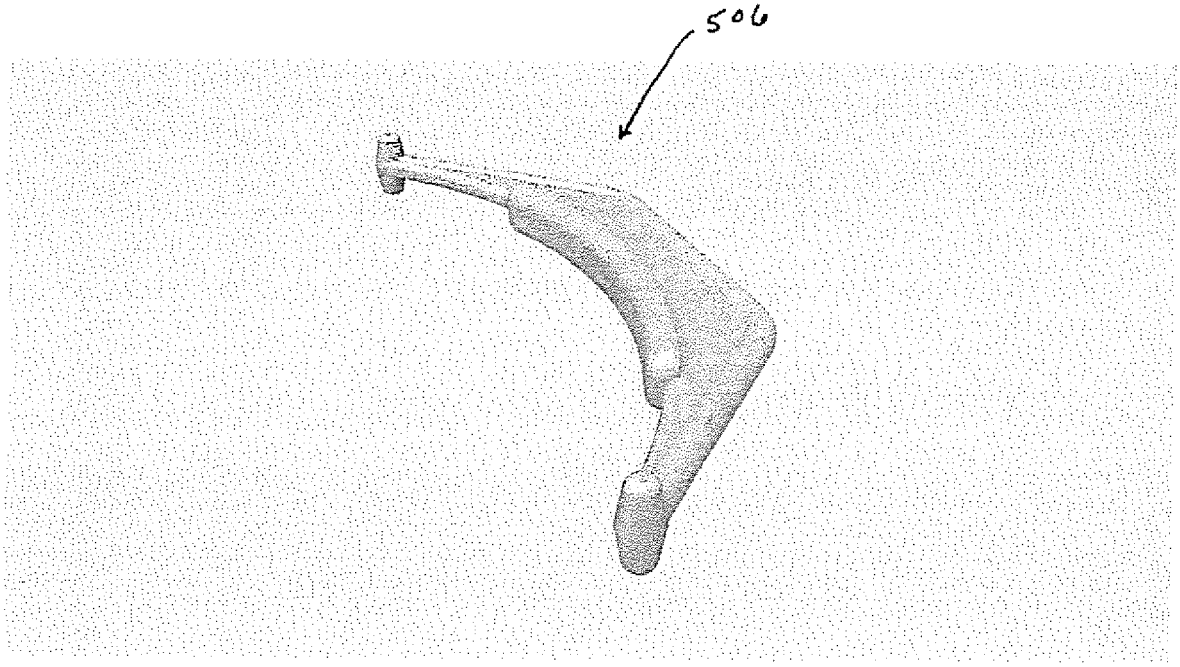
FIG. 42 is a schematic depicting an exemplary gusset.

Referring to FIGS. 41 and 42, in addition to dovetail system 325 as described with reference to console 300, console 500 further comprises a plurality of snap-in corner gussets 506 which may be used to further secure the corners of housing 302 together. An exemplary snap-in gusset is shown, e.g., in FIG. 42. Gusset 506 maintains vertical and horizontal position to help maintain the integrity of housing 302.

Figure 43:
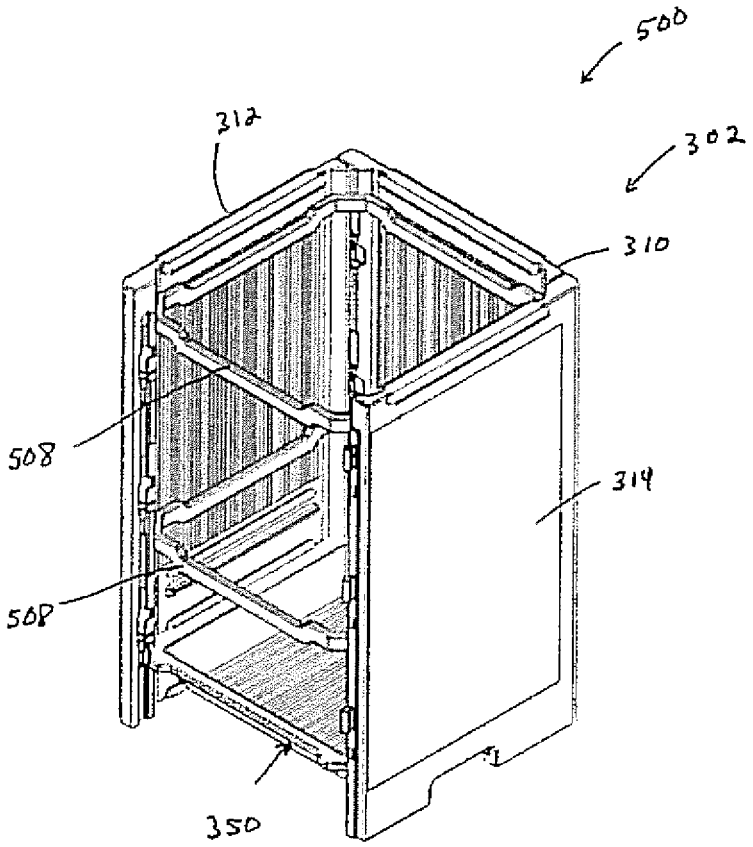
FIG. 43 is a schematic depicting an exemplary document console, wherein the panels of the console are further secured to one another via a plurality of barrel gussets.

Referring to FIG. 43, console 500 may comprise one or more of a barrel gusset 508. Instead of just attaching corners, gusset 508 spans about 50% of the internal panels: one full panel, and two half-panels to the left and the right of the one full panel. Another gusset 508 may bind the other half of housing 302.

Figure 46:
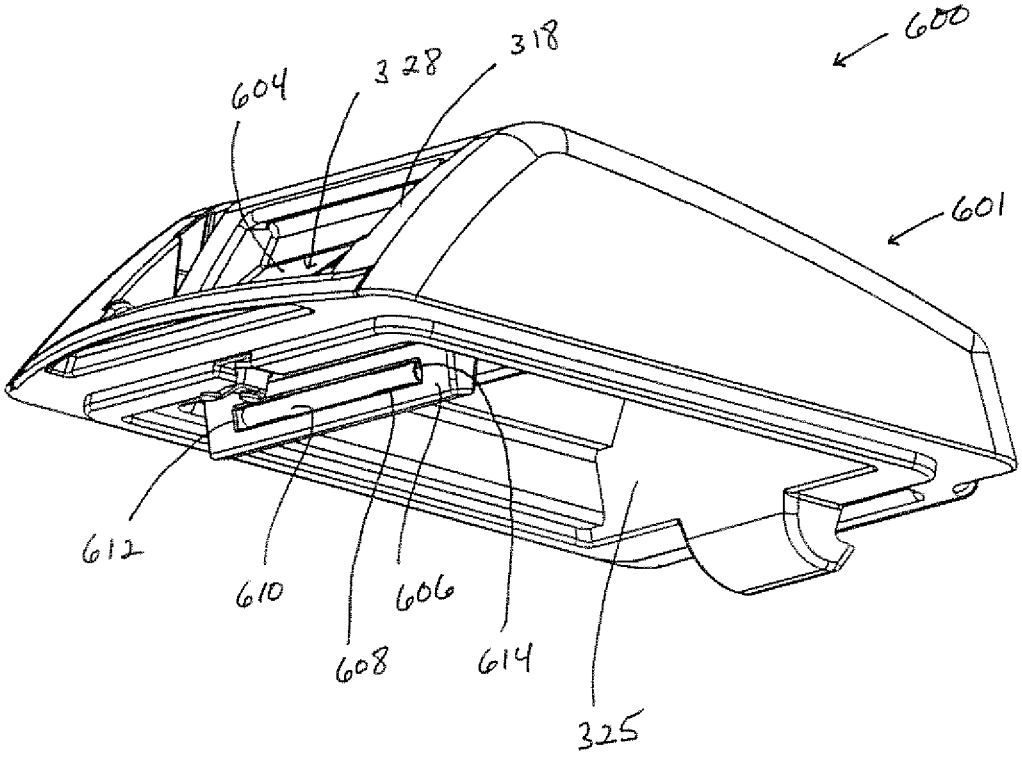
FIG. 46 is a schematic depicting a portion of an exemplary console comprising an exemplary weighting member.

Referring to FIG. 46, an exemplary console 600 may comprise any one or all of the features described above herein and/or as shown in FIGS. 1-45. In addition, an upper member 601 of console 600 comprises a weighting member which serves to ensure that door 328 tightly covers the opening formed through forward side 318. As shown in FIG. 46, door 328 has an upper plate 604 joined to a lower plate 606. Upper plate 604 covers the opening, while lower plate 606 is positioned within chamber 325 of upper member 601. Lower plate 606 has a longitudinally extending slot 608 formed therethrough. A bar 610 is positioned within slot 608 and is secured therein via attachment of bar 610 to a proximal interior wall 612 and to an oppositely situated distal interior wall 614 of lower plate 606. In a preferred embodiment, bar 610 is sufficiently weighted to forcefully shut door 328 when console 600 is not in use to thereby limit the amount of oxygen that can enter console 600. The weighted member is particularly advantageous in the event that a fire is ignited in the console, as the lack of oxygen within the chamber of the console will assist in the extinguishing the fire.

The document consoles described herein provide for a document console that secures the confidentiality of the documents contained therein, and which allows for a determination as to whether the holding capacity of the console has been reached. The consoles allow for versatile holding capacities, and allow for easy assembly and manufacture. Due to the static reducing features of document consoles, the consoles provide a ready means for emptying the consoles thereby creating greater efficiency and speed when emptying the consoles and reducing the number of injuries sustained by workers engaged to empty the consoles.

What has been described is merely illustrative of the application of the principles of the invention. Other arrangements and methods can be implemented by those skilled in the art without departing from the spirit and scope of the present invention.

What is claimed is:

1. A document console, comprising:

an upper member comprising:

a body which surrounds a first chamber, wherein a bottom side of the body is open-ended and leads into the first chamber, and further wherein the body has an opening formed therethrough, wherein the opening is in fluid communication with the first chamber; and a door pivotally connected to the body of the upper member, wherein the door comprises an upper member joined to a lower member, wherein the upper member covers the opening of the upper member when the door is in a closed position and which reveals the opening when the door is in an open position, and wherein the lower member is positioned within the first chamber, and further wherein the lower member of the door comprises a body having a longitudinally extending slot formed therethrough, wherein the slot begins at a proximal lateral side of the body of the lower member of the door to form a proximal interior wall and ends at distal lateral side of the body of the lower member of the door to form a distal interior wall;

a weighted member which comprises a longitudinally extending bar which is disposed within the slot and wherein oppositely situated ends of the bar are respectively received by and secured to the proximal and distal interior walls of the lower member of the door; and a housing having a body comprising a plurality of side walls, wherein each of the side walls of the plurality has a top edge oppositely situated to a bottom edge and a proximal edge oppositely situated to a distal edge, and further wherein each of the proximal edges of the side walls is joined to the distal edge of the immediately adjacently positioned side wall of the plurality via a mating member which is integrally formed on each of the proximal and distal edges of the side walls of the plurality, and further wherein each of the side walls of the plurality of side walls has an interior surface oppositely situated to an exterior surface, and further wherein the housing has a second chamber which is surrounded by the interior surfaces of the side walls of the body of the housing and by a bottom side of the housing, wherein the bottom side is positioned towards the bottom edges of the plurality of side walls;

wherein the open-ended bottom side of the body of the upper member is disposed on the top edges of the side walls of the plurality of side walls of the housing.

2. The document console of claim 1, wherein the plurality of side walls of the housing comprises a forward panel oppositely situated to a rearward panel, and a proximal panel oppositely situated to a distal panel, wherein all of the panels comprise a top edge oppositely situated to a bottom edge, wherein the top edges of the panels are joined to the upper member, and further wherein each of the proximal and distal panels has a pair of slots formed therein; and wherein:

the console further comprises a first foot and a second foot, wherein each of the first foot and the second foot comprises a longitudinally extending body which comprises a bottom side which turns upwards into a distal lateral wall on one side thereof and upwards into a proximal lateral wall on an opposite side thereof such that a longitudinally extending well is formed between the distal and lateral walls of each of the first foot and the second foot, and further wherein each of the proximal lateral walls have a pair of flanges formed therein;

wherein the bottom edge of the proximal panel is received within the well of the first foot and the pair of flanges of the first foot is received within the pair of slots formed on the proximal panel, and wherein the bottom of the distal panel is received within the well of the second foot and the pair of flanges of the second foot is received within the pair of slots formed on the distal panel.

3. The document console of claim 1, wherein the interior surfaces of the housing form a generally conical configuration, wherein a first diameter of the conical configuration located towards the bottom edges of the plurality of side walls of the housing is less than a second diameter of the conical configuration located towards the top edges of the plurality of side walls of the housing.

4. The document console of claim 3, wherein the interior surfaces of the housing are positioned relative to one another to form a draft of about 1.5 degrees.

5. The document console of claim 3, wherein one or more of the interior surfaces of the plurality of side walls comprise a texturized surface.

6. The document console of claim 5, wherein the texturized surface includes a plurality of longitudinally extending ribs formed within one or more of the interior surfaces of the plurality of side walls, wherein the plurality of ribs extends towards the top and bottom edges of the plurality of side walls of the housing.

7. The document console of claim 1, further comprising:

two or more sets of tabs, wherein each set of tabs is disposed on the interior surface of the plurality of side walls of the housing; and a base member comprising a plurality of side walls which surround and extend from a bottom side of the base member to form a third chamber, wherein the third chamber is in fluid communication with the first chamber, and wherein the base member is held by one of the two or more sets of tabs, and wherein the position of the base member relative to the housing is altered by moving the base member from one set of tabs to another one of the sets of tabs.

8. The document console of claim 7, wherein the base member comprises a generally trapezoidal configuration.

9. The document console of claim 7, wherein the bottom side of the base member is texturized.

10. The document console of claim 1, wherein the mating member integrally formed on the proximal edges of the side walls of the plurality comprises a male mating member, and the mating member integrally formed on the distal edges of the side walls of the plurality comprises a female mating member, wherein the male mating member and the female mating member of the respective proximal and distal edges of the respective side walls are joined together via a male and female dovetail system such that the adjacently positioned side walls from the plurality are snap fit to one another.

11. The document console of claim 1, wherein a side wall from the plurality of side walls of the housing has an opening formed therethrough, and wherein the document console further comprises a window secured over the opening.

12. The document console of claim 1, wherein, at a position located opposite to the door, the body of the upper member extends away from the housing to form a first flange oppositely situated to a second flange, and wherein the console further comprises a longitudinally extending bar which is received by and secured between the first and second flanges.

* * * * *